US011331931B2

(12) United States Patent
Arakane et al.

(10) Patent No.: US 11,331,931 B2
(45) Date of Patent: May 17, 2022

(54) LIQUID DROPLET DISCHARGE APPARATUS

(71) Applicant: BROTHER KOGYO KABUSHIKI KAISHA, Nagoya (JP)

(72) Inventors: Satoru Arakane, Nagoya (JP); Hirotoshi Maehira, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 44 days.

(21) Appl. No.: 17/034,607

(22) Filed: Sep. 28, 2020

(65) Prior Publication Data

US 2021/0094315 A1 Apr. 1, 2021

(30) Foreign Application Priority Data

Sep. 30, 2019 (JP) ..... JP2019-180569

(51) Int. Cl.

*B41J 2/21* (2006.01)
*B41J 2/045* (2006.01)
*B41J 29/393* (2006.01)

(52) U.S. Cl.

CPC ..... *B41J 2/2135* (2013.01); *B41J 2/04508* (2013.01); *B41J 2/04586* (2013.01); *B41J 29/393* (2013.01)

(58) Field of Classification Search

CPC .. B41J 2/04508; B41J 2/04586; B41J 2/2135; B41J 13/0009; B41J 29/393

See application file for complete search history.

(56) References Cited

U.S. PATENT DOCUMENTS

| | | | | |
|---|---|---|---|---|
| 5,847,721 | A | 12/1998 | Ogata et al. | |
| 10,870,293 | B2 * | 12/2020 | Mimoto | B41J 2/2132 |
| 2013/0257981 | A1 | 10/2013 | Ito et al. | |
| 2014/0009520 | A1 | 1/2014 | Hasegawa et al. | |

FOREIGN PATENT DOCUMENTS

| | | | |
|---|---|---|---|
| JP | 8-244253 | A | 9/1996 |
| JP | 2007296748 | A | 11/2007 |
| JP | 2013208731 | A | 10/2013 |
| JP | 201412374 | A | 1/2014 |

* cited by examiner

*Primary Examiner* — Thinh H Nguyen

(74) *Attorney, Agent, or Firm* — Scully, Scott, Murphy & Presser, PC

(57) ABSTRACT

A liquid droplet discharge apparatus includes: a conveyor which conveys a recording medium in a sub-scanning direction; a head unit including first-kind nozzles and at least one second-kind nozzle; a moving device configured to move the head unit in a main scanning direction intersecting with the sub-scanning direction; and a controller. The controller executes: a first data generation process for generating a first data being used for forming a first image; a second data generation process for generating a second data being used for forming a second image; and a forming process for forming dots by controlling the head unit, the moving device, and the conveyor based on the first data and the second data to discharge liquid droplets on the recording medium.

19 Claims, 16 Drawing Sheets

P (k)
P (k+1)
NL
411
NK
NC
NZ
Blk (v)
Blc (v)
Blk (v+1)
Blc (v+1)
Ro5
Ro6
t
t+1
t+2
Dx
-Dx
Dy
-Dy

LIQUID DROPLET DISCHARGE APPARATUS

CROSS REFERENCE TO RELATED APPLICATION

The present application claims priority from Japanese Patent Application No. 2019-180569 filed on Sep. 30, 2019, the disclosure of which is incorporated herein by reference in its entirety.

BACKGROUND OF THE INVENTION

Field of the Invention

The present specification relates to a technique in which a dot pattern is formed by performing a forming process and a conveyance process a plurality of times. In the forming process, a dot is formed by discharging a liquid droplet on a recording medium during movement in a main scanning direction of a head unit including nozzles. In the conveyance process, the recording medium is conveyed in a sub-scanning direction.

Description of the Related Art

There is known a printer in which an image is printed by discharging ink from nozzles of a head unit having nozzles. For example, the printer prints an entire image by repeating printing of a band, which is a part of the image. There is suggested a technique for inhibiting image forming velocity from being reduced while inhibiting white streaks and density unevenness at a boundary between bands. Specifically, each band has at least one end in which a pixel pattern that is complementary to a pixel pattern of an end of another band adjacent thereto in the sub-scanning direction is formed.

SUMMARY

A plurality of kinds of inks may be used for printing. Here, the total number of nozzles may depend on the kinds of inks. In this case, it may be difficult to adopt a pixel pattern that is suitable for a specified ink to another ink. This problem is caused not only in a technique in which an image is printed using ink but also in a technique in which a dot is formed by discharging liquid droplets.

The present specification discloses a technique for appropriately forming a plurality of dots of the first liquid and a plurality of dots of the second liquid when the number of nozzles from which the first liquid is discharged is different from the number of nozzles from which the second liquid is discharged.

According to an aspect of the present disclosure, there is provided a liquid droplet discharge apparatus, including:

a conveyor configured to convey a recording medium in a sub-scanning direction;

a head unit including first-kind nozzles and at least one second-kind nozzle, the first-kind nozzles having mutually different positions in the sub-scanning direction, each of the first-kind nozzles discharging first-kind liquid droplets, the first-kind liquid droplets being liquid droplets of a first liquid, the at least one second-kind nozzle discharging second-kind liquid droplets, the second-kind liquid droplets being liquid droplets of a second liquid, the number of the at least one second-kind nozzle is less than the number of the first-kind nozzles;

a moving device configured to move the head unit in a main scanning direction intersecting with the sub-scanning direction; and a controller, wherein the controller is configured to execute:

a first data generation process for generating a first data, the first data being used for forming a first image, the first data indicating a first-kind preceding dot area and a second-kind preceding dot area, the first-kind preceding dot area being an area in which the first-kind liquid droplets are to be discharged, the second-kind preceding dot area being an area in which the second-kind liquid droplets are to be discharged;

a second data generation process for generating a second data, the second data being used for forming a second image, the second data indicating a first-kind succeeding dot area and a second-kind succeeding dot area, the first-kind succeeding dot area being an area in which the first-kind liquid droplets are to be discharged, the second-kind succeeding dot area being an area in which the second-kind liquid droplets are to be discharged; and a forming process for forming dots by controlling the head unit, the moving device, and the conveyor based on the first data and the second data to discharge liquid droplets on the recording medium, the first-kind preceding dot area includes a first-kind overlap range, the first-kind overlap range overlapping with the first-kind succeeding dot area, and the second-kind preceding dot area includes a second-kind overlap range, the second-kind overlap range overlapping with the second-kind succeeding dot area.

In the above configuration, the dot included in the first-kind preceding dot area and the dot included in the first-kind succeeding dot area are arranged in the first-kind overlap range. The dot included in the second-kind preceding dot area and the dot included in the second-kind succeeding dot area are arranged in the second-kind overlap range. It is thus possible to form an appropriate image by the first-kind liquid droplet and the second-kind liquid droplet by use of the head unit having the first-kind nozzles and the at least one second-kind nozzle.

The technique disclosed in the present specification can be achieved in variety of aspects. For example, the technique can be achieved in aspects including a control method and a control apparatus of a printing execution section, a generation method and a generation apparatus of printing data, a computer program for achieving the methods or functions of the apparatuses, a recording medium storing the computer program (e.g., a non-transitory recording medium), and the like.

DESCRIPTION OF THE EMBODIMENTS

[First the Embodiment] <Device Configuration>

Figure 1:
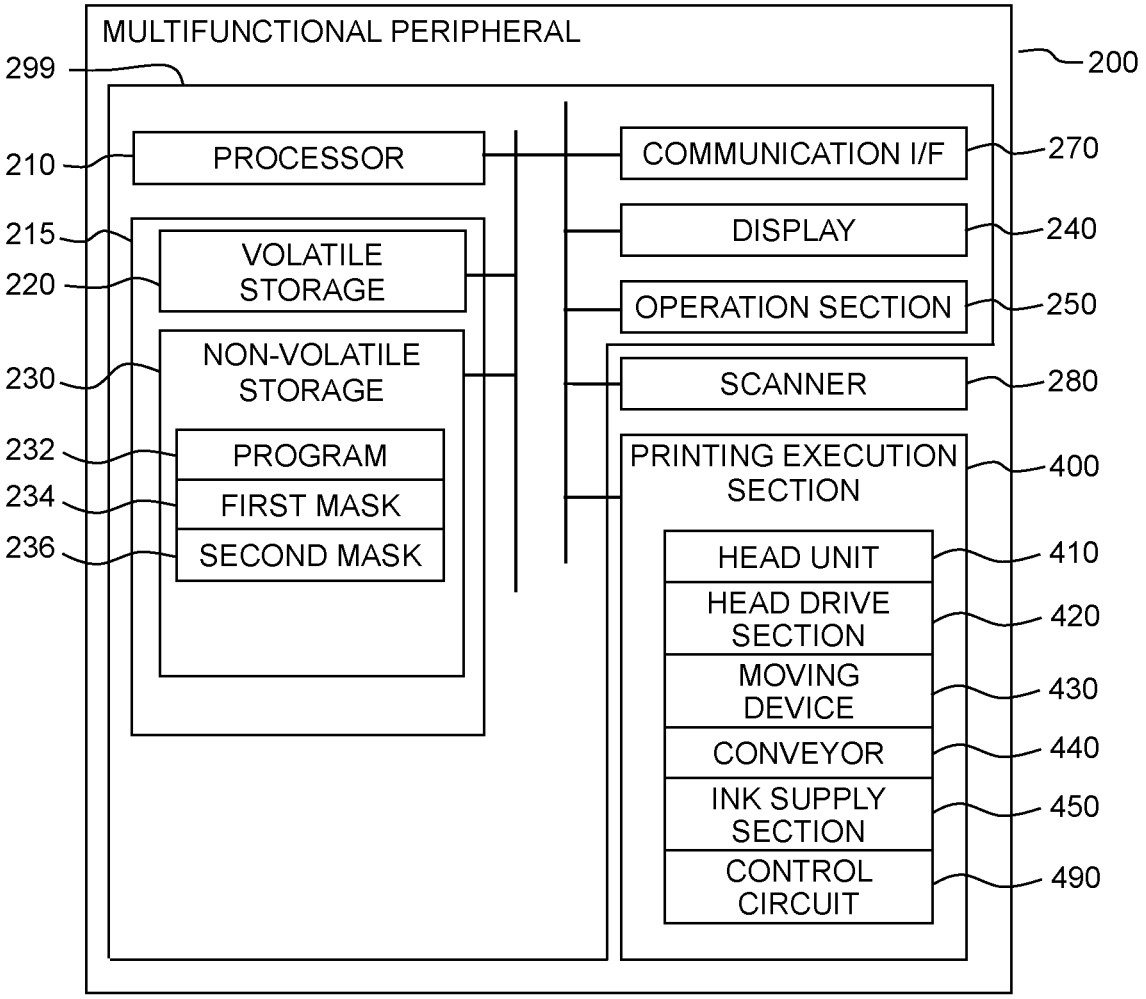
FIG. 1 illustrates a multifunctional peripheral that is an embodiment of a liquid droplet discharge apparatus.

Referring to FIG. 1, configuration of a multifunction peripheral 200, which is an embodiment of a liquid droplet discharge apparatus, will be described. The multifunction peripheral 200 includes a controller 299, a scanner unit 280, and a print executing unit 400. The controller 299 includes a processor 210, a storage device 215, a display unit 240 for displaying an image, an operation unit 250 for accepting an operation by a user, and a communication interface 270. These elements are connected to each other via a bus. The storage device 215 includes a volatile storage device 220 and a nonvolatile storage device 230.

The processor 210 is a device that performs data processing, for example, a CPU. The volatile storage device 220 is, for example, a DRAM, and the nonvolatile storage device 230 is, for example, a flash memory.

The non-volatile storage device 230 stores a program 232, a first mask data 234, and a second mask data 236. The processor 210 implements various functions by executing the program 232 (described later in detail). Processor 210 temporarily stores various intermediate data to be used to execute program 232 in the storage device (e.g., either the volatile storage device 220 or the non-volatile storage device 230). In this embodiment, the program 232, and the mask data 234 and 236 are stored in advance in the nonvolatile storage device 230 as firmware by the manufacturer of the multifunction peripheral 200. Details of the mask data 234 and 236 will be described later.

The display unit 240 is a device for displaying an image, such as a liquid crystal display, an organic EL display, or the like. The operation unit 250 is a device that receives an operation by a user, such as a touch panel disposed on the display unit 240 in a superimposed manner, a button, a lever, and the like. The user can input various instructions to the multifunction peripheral 200 by operating the operation unit 250. The communication interface 270 is an interface for communicating with other devices (e.g., a USB interface, a wired LAN interface, or a wireless interface of IEEE802.11).

The scanner unit 280 is a reading device that optically reads an object such as a document using a photoelectric conversion element such as a CCD or a CMOS. The scanner unit 280 generates read data representing the read image (referred to as "read image") (for example, RGB bit map data).

The printing execution unit 400 is a device for printing an image on a paper (an example of the recording medium). In this embodiment, the print executing unit 400 includes a head unit 410 (simply referred to as a head 410), a head driving unit 420, a moving device 430, a conveyor 440, an ink supplying section 450, and a control circuit 490 that controls these elements 410, 420, 430, 440, and 450. The printing execution unit 400 is an inkjet printing apparatus using inks of cyan C, magenta M, yellow Y, and black K. The control circuit 490 is configured by, for example, a dedicated electric circuit for driving a motor or the like. The control circuit 490 may include a computer.

The controller 299 generates print data by using image data selected by the user, and causes the print executing unit 400 to print images using the generated print data. The user can select the read data or an image data stored in an external storage device (e.g., a memory card connected to the communication interface 270). Further, the controller 299 may cause the print executing unit 400 to print an image by using the print data supplied by another external apparatus connected to the multifunction peripheral 200.

Figure 2:
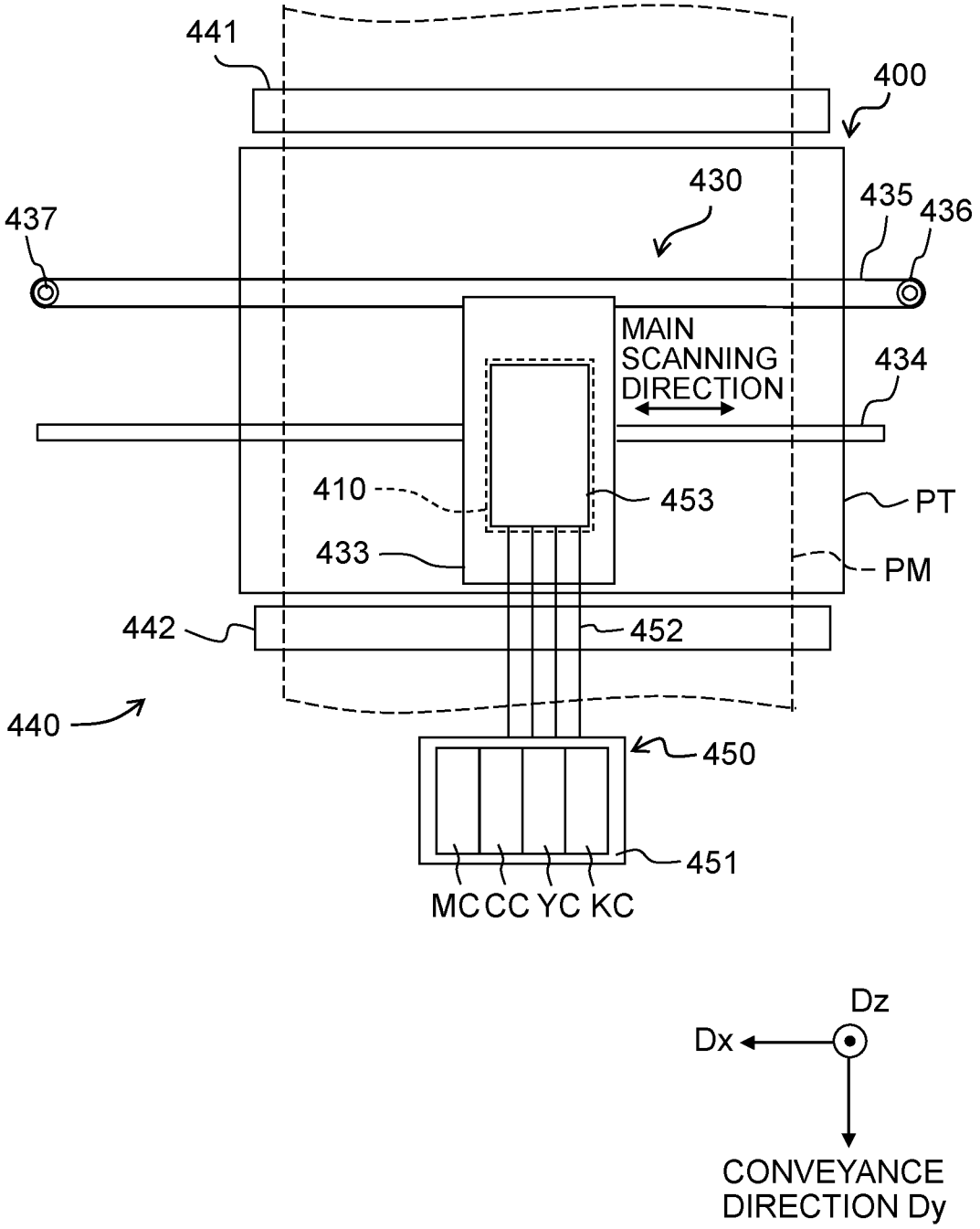
FIG. 2 schematically depicts a printing execution section.

Referring to FIG. 2, the schematic configuration of the print executing unit 400 will be described. The moving device 430 includes a carriage 433, a sliding shaft 434, a belt 435, a plurality of pulleys 436, 437. The carriage 433 mounts the head 410. The sliding shaft 434 holds the carriage 433 reciprocally along the main scanning direction (direction parallel to the Dx direction). The belt 435 is wound around pulleys 436, 437, and a portion of the belt 435 is fixed to the carriage 433. The pulley 436 is rotated by the power of a main scanning motor (not shown). When the main scanning motor rotates the pulley 436, the carriage 433 moves along the sliding shaft 434. Thus, the main scanning that reciprocates the head 410 along the main the scanning direction with respect to the paper PMs is realized.

The conveyor 440 conveys the paper PM in a Dy direction perpendicular to the main scanning direction with respect to the head 410 while holding the paper PM. In the following, the Dy direction is also referred to as a conveyance direction Dy. The first side in the Dy direction is also referred to as a + side in the Dy direction, and the second side in the Dy direction is also referred to as a − side in the Dy direction. A direction directed from the − side toward the + side in the Dy direction is referred to as a +Dy direction, and a direction directed from the + side toward the − side in the Dy direction is referred to as a −Dy direction. The same is true of a +Dx direction and a −Dx direction. Printing of an image on the paper PM is performed from the + side toward the − side in the Dy direction on the paper PM. In the following, the + side in the Dy direction is also referred to as an upstream side, and − side in the Dy direction is also referred to as a downstream side.

The conveyor 440 includes: a platen PT configured to support the paper PM and disposed to face a surface of the head 410 from which ink is discharged; the first roller 441 and the second roller 442 configured to hold the paper PM disposed on the platen PT; and a motor (not depicted) that drives the rollers 441 and 442. The first roller 441 is disposed at the − side of the head 410 in the Dy direction, and the second roller 442 is disposed at the + side of the head 410 in the Dy direction. The paper PM is supplied to the conveyor 440 from a sheet tray (not depicted) by use of a feed roller (not depicted). The paper PM supplied to the conveyor 440 is interposed between the first roller 441 and a driven roller (not depicted). The first roller 441 and the driven roller form a roller pair. The paper PM is conveyed by those rollers toward a Dy side in a sub-scanning direction. The paper PM conveyed is interposed between the second roller 442 and a driven roller (not depicted). The second roller 442 and the driven roller form a roller pair. The paper PM is conveyed by those rollers toward the Dy side in the sub-scanning direction. The conveyor 440 conveys the paper PM in the conveyance direction Dy by driving the rollers 441 and 442 through power of the motor. In the following, a process for moving the paper PM in the conveyance direction Dy is referred to as sub-scanning or a conveyance process. The conveyance direction Dy is also referred to as the sub-scanning direction Dy. A Dz direction indicated in the drawings is a direction directed from the platen PT toward the head 410 and perpendicular to the two directions Dx and Dy.

The ink supply section 450 supplies ink to the head 410. The ink supply section 450 includes a cartridge installation section 451, tubes 452, and a buffer tank 453. Ink cartridges KC, YC, CC, and MC, which contain inks, are removably installed in the cartridge installation section 451. Inks are supplied from the ink cartridges to the head 410. The buffer tank 453 is disposed above the head 410 carried on the carriage 433. The buffer tank 453 temporarily and separately contains each of the inks of CMYK to be supplied to the head 410. The tubes 452 are flexible tubes that are ink channels connecting the cartridge installation section 451 and the buffer tank 453. Inks in the respective ink cartridges are supplied to the head 410 via the cartridge installation section 451, the tubes 452, and the buffer tank 453.

Figure 3:
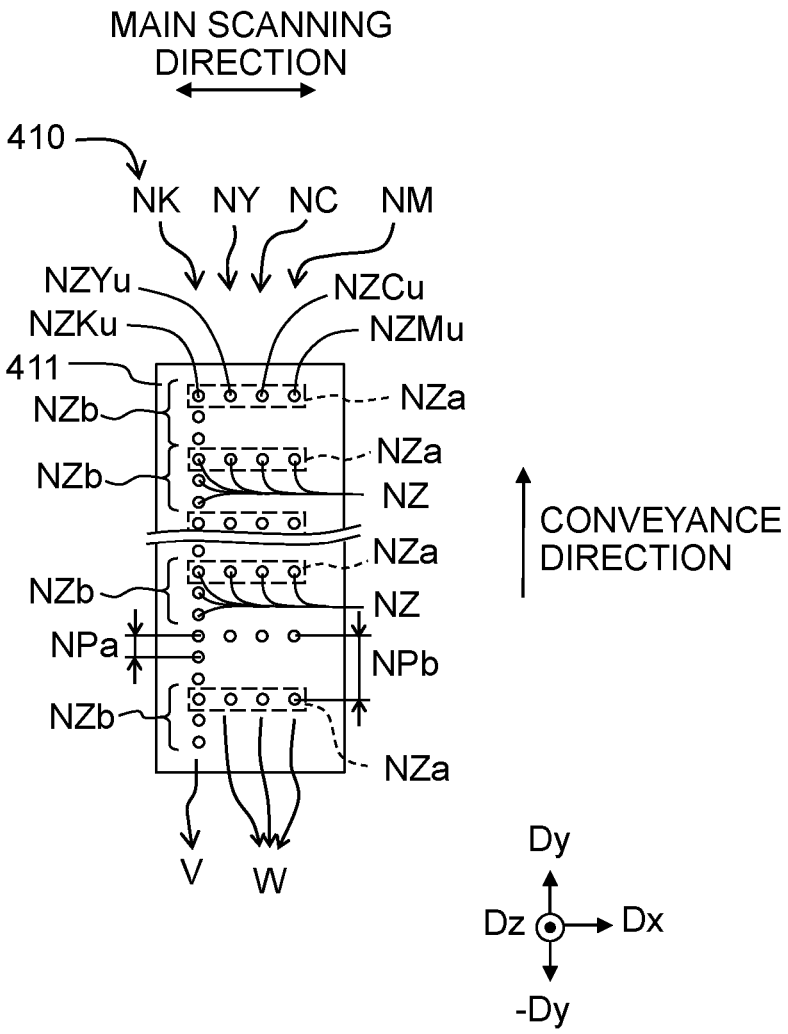
FIG. 3 is a perspective view of a configuration of a head.

FIG. 3 is a perspective view depicting a configuration of the head 410 when seen in a −Dz direction. FIG. 3 is different from FIG. 2 in that the sub-scanning direction Dy is directed upward. Nozzle groups NK, NY, NC, and NM from which inks of K, Y, C, and M are discharged are formed in a nozzle forming surface 411 that is a surface at the − side in the Dz direction of the head 410. Each nozzle group includes nozzles NZ. The nozzles NZ in one nozzle group have mutually different positions in the sub-scanning direction Dy. Positions in the main scanning direction of the nozzle groups NK, NY, NC, and NM are different from each other. In the example of FIG. 3, the nozzle groups NK, NY, NC, and NM are arranged in the +Dx direction in that order.

In the nozzle group NK of the black K in this embodiment, the nozzles NZ are arranged in the sub-scanning direction Dy at regular intervals, which are the first nozzle pitch NPa. In the nozzle groups NY, NC, and NM of YCM, the positions in the sub-scanning direction Dy of the nozzles NZ are arranged at regular intervals, which are the second nozzle pitch NPb. Each of the pitches NPa and NPb is a positional difference in the sub-scanning direction Dy between two nozzles NZ adjacent to each other in the sub-scanning direction Dy. In this embodiment, the second nozzle pitch NPb is F times (F is an integer or integral number equal to or more than two) the first nozzle pitch NPa. In the example of FIG. 3, F=3 is satisfied.

FIG. 3 depicts most upstream nozzles NZKu, NZYu, NZCu, and NZMu that are included in the nozzle groups NK, NY, NC, and NM and positioned at the most upstream side (+ side in the Dy direction). In this embodiment, the most upstream nozzles NZKu, NZYu, NZCu, and NZMu have the same direction in the sub-scanning direction Dy. FIG. 3 depicts nozzle sets NZa. Each nozzle set NZa is formed by four nozzles NZ each of which is selected from one of the four nozzle groups NK, NY, NC, and NM. The nozzle set NZa is a set of the four nozzles NZ arranged at the same position in the sub-scanning direction Dy (hereinafter, the nozzle set Nza is also referred to as an identical position set NZa). As described above, the second nozzle pitch NPb is F times the first nozzle pitch NPa. Thus, when following the nozzles NZ of the nozzle group NK of the black K in the −Dy direction, the identical position set Nza is formed for each F-pieces of nozzle NZ.

In this embodiment, the nozzle groups NY, NC, and NM of YCM have the same total number of nozzles NZ, which is W. The total number of the nozzles NZ of the nozzle group NK of the black K is V. In this embodiment, V is F times W. Thus, the nozzle groups NK, NY, NC, and NM form W pieces of nozzle set NZb arranged in the sub-scanning direction Dy. Each nozzle set NZb is formed by one identical position set NZa and "F−1" pieces of nozzle NZ of the black K arranged at the − side in the Dy direction with respect to the identical position set NZa (hereinafter the nozzle set NZb is also referred to as a reference set NZb). In the example of FIG. 3, one nozzle set NZb is formed by one identical position set NZa and additional two nozzles NZ of the black K. V is an integer equal to or more than two. W is an integer equal to or more than one and less than V.

Each nozzle NZ is connected to the buffer tank 453 (FIG. 2) via an ink channel (not depicted) formed in the head 410. Each ink channel is provided with an actuator (not depicted, e.g., a piezo element, a heater, or the like) for discharging ink.

The head drive section 420 (FIG. 1) includes the electrical circuit that drives each actuator in the head 410 during the main scanning performed by the moving device 430. Ink is thus discharged from the nozzle NZ of the head 410 on the paper PM, forming a dot. In the following, a process in which ink droplets are discharged on the paper PM during movement in the main scanning direction of the head unit 410 to form dots is also referred to as forming process. The head 410, the head drive section 420, and the moving device 430 perform the forming process to form an image on the paper PM.

<Outline of Printing>

Figure 4:
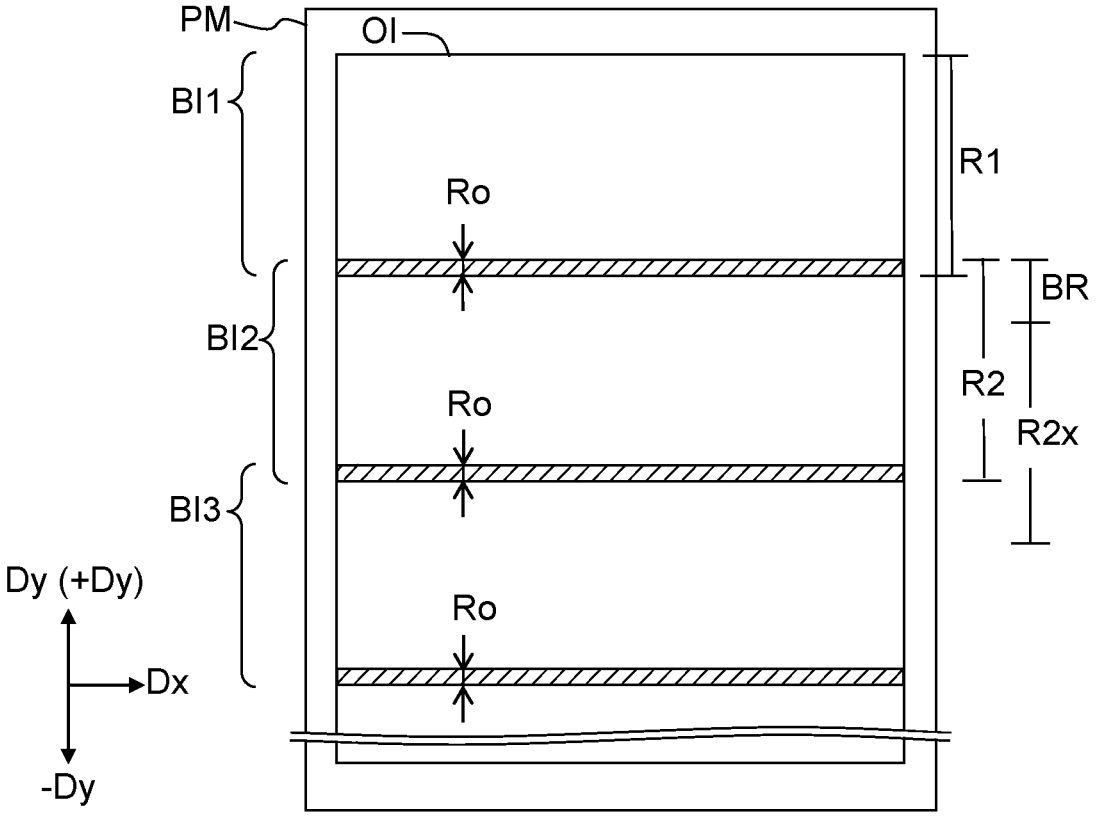
FIG. 4 schematically illustrates printing by the printing execution section.

Referring to FIG. 4, explanation is made about the outline of printing by the printing execution section 400. FIG. 4 depicts an object image OI to be printed on the paper PM. The object image OI includes band images BI1 to BI3 arranged in the −Dy direction (more generally, in the sub-scanning direction Dy) from an end at the + side in the Dy direction of the object image OI. The shape of each of the band images BI1 to BI3 is a rectangular shape extending in the main scanning direction (here, a direction parallel to the direction Dx). In this embodiment, a width in the sub-scanning direction Dy of each band image is a fixed value determined in advance. Each of the band images BI1 to BI3 is printed by performing the forming process once or a plurality of times. In the following, the forming process performed once is referred to as a "pass process" or simply referred to as a "pass". In each forming process, the head 410 moves toward any one side of the main scanning direction (in the +Dx direction or the −Dx direction). Here, the forming process in the +Dx direction and the forming process in the −Dx direction may be performed alternately (also referred to as bidirectional printing). Or, the moving direction of the head 410 in the forming process may be one direction determined in advance.

The band images are sequentially printed one by one in the −Dy direction in the order starting from a band image positioned at the end on the + side in the Dy direction of the object image OI. Ranges in the sub-scanning direction Dy of two adjacent band images partially overlap with each other. Overlap ranges Ro are ranges where the ranges in the sub-scanning direction Dy of the two band images adjacent to each other overlap with each other. For example, the overlap range Ro positioned at the most + side in the Dy direction is a range where a range in the sub-scanning direction Dy of the first band image BI1 overlaps with a range in the sub-scanning direction Dy of the second band image BI2. The shape of an image included in each overlap range Ro is a rectangle extending in the main scanning direction. In this embodiment, a width in the sub-scanning direction Dy of each overlap range Ro is a fixed value determined in advance. Dots included in the overlap range Ro are printed by being distributed to two band images. Namely, when a band image positioned at the upstream side (+ side in the Dy direction) is printed, some of the dots in the overlap range Ro are printed. When a band image positioned at the downstream side (− side in the Dy direction) is printed, remaining dots in the overlap range Ro are printed. This inhibits failure in color to be printed (e.g., white streaks and/or density unevenness) at a boundary (i.e., the overlap range Ro) between the band image at the upstream side (+ side in the Dy direction) and the band image at the downstream side (− side in the Dy direction).

Figure 5:
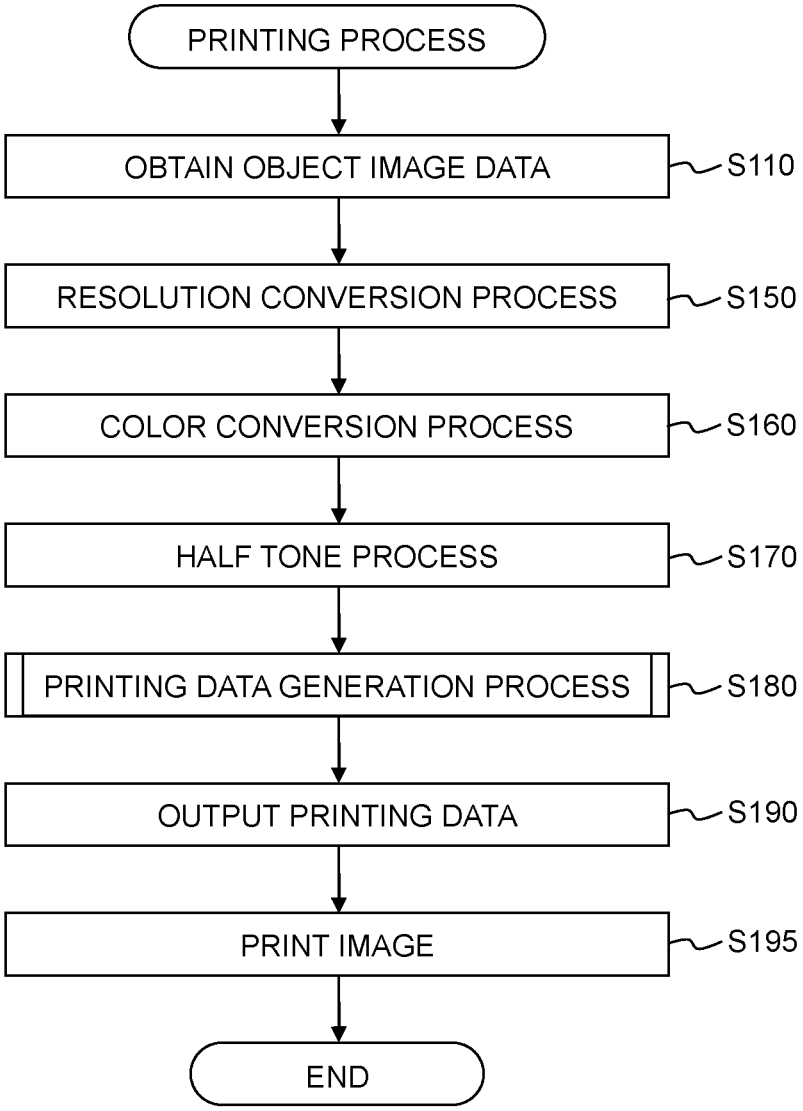
FIG. 5 is a flowchart indicating an example of a printing process.

Referring to FIG. 5 an exemplary printing process is explained. The controller 299 of the multifunction peripheral 200 starts the process of FIG. 5 in response to a printing instruction from a user. The processor 210 executes the process of FIG. 5 in accordance with the program 232. An input method of the printing instruction may be any method. In this embodiment, the user inputs the printing instruction by operating the operation section 250 (FIG. 1). The printing instruction includes information that designates object image data indicating an object image for printing. The object image data may be a variety of data. For example, the object image data may be image data stored in the storage 215 (e.g., the non-volatile storage 230).

In S110, the processor 210 obtains the object image data designated by the printing instruction. In this embodiment, bitmap data is used as the object image data. A pixel value of each pixel of the object image data is indicated by gradation values of R (red), G (green), and B (blue) that have 256 gradations from 0 to 255. When the image data designated by the printing instruction is JPEG data, the processor 210 obtains the object image data by developing or expanding the JPEG data. When a format of the image data designated by the printing instruction is different from the bitmap format (e.g., an Enhanced Meta File (EMF) format), the processor 210 uses the bitmap data generated by converting the data format (e.g., rasterize) as the object image data.

In S150, the processor 210 executes a process for converting a resolution of the object image data (i.e., pixel density), thus generating object image data having a resolution for printing that is determined in advance. In the following, pixels having the resolution for printing are also referred to as printing pixels. When the resolution of the object image data is the same as the resolution for printing, S150 is omitted.

In S160, the processor 210 executes a color conversion process of the object image data. The color conversion process is a process for converting a color value (in this embodiment, the RGB value) of the object image data into a color value of an ink color space. The ink color space corresponds to a plurality of kinds of ink colors that can be used for printing (in this embodiment, CMYK color space). The processor 210 executes the color conversion process by referring to a color conversion profile (not depicted) that indicates a correspondence relationship between the color value of the color space of the object image data and the color value of the ink color space. In this embodiment, the color conversion profile is a look-up table.

In S170, the processor 210 executes a half tone process of the object image data of which color has been converted. In other words, in S170, the processor 210 generates first-kind preceding band image which is used for forming the band image BI1. The first-kind preceding band image indicates a first-kind preceding band range which is a band in which the black liquid droplets are to be discharged and a second-kind preceding band range which is a band in which at least one of cyan liquid droplets, magenta liquid droplets and yellow liquid droplets are to be discharged. In S170, the processor 210 also generates first-kind succeeding band image which is used for forming the band image BI2. The first-kind succeeding band image indicates a first-kind succeeding band range which is a band in which the black liquid droplets are to be discharged and a second-kind preceding band range which is a band in which at least one of cyan liquid droplets, magenta liquid droplets and yellow liquid droplets are to be discharged. The half tone process may be a variety of method, such as an error diffusion method or a method for using a dither matrix. In the half tone process, dot data indicating a dot forming state is generated for each color component and each printing pixel. The dot forming state is a state of the dot to be formed by printing. In this embodiment, the dot forming state is any of "with dot" and "no dot". Or, the dot forming state may be selected from among three or more states (e.g., "large dot", "medium dot", "small dot", and "no dot") that have different dot sizes and include two or more "with dot" states. In any case, the dot data indicates a value corresponding to the dot forming state.

In S180, the processor 210 generates printing data by using the dot data. The printing data is data having a data format that can be interpreted by the control circuit 490 of the printing execution section 400 (FIG. 1). Details of the process in S180 are described below. In S190, the processor 210 outputs the printing data to the printing execution section 400. In S195, the control circuit 490 of the printing execution section 400 prints an image by controlling the control execution section 400 based on the printing data. Namely, the control circuit 490 controls the head unit 410, the moving device 430 and the conveyor 440 based on the first-kind preceding band image and the first-kind succeeding band image for discharging liquid droplets on the paper PM. Then, the process in FIG. 5 is completed.

Figure 6A:
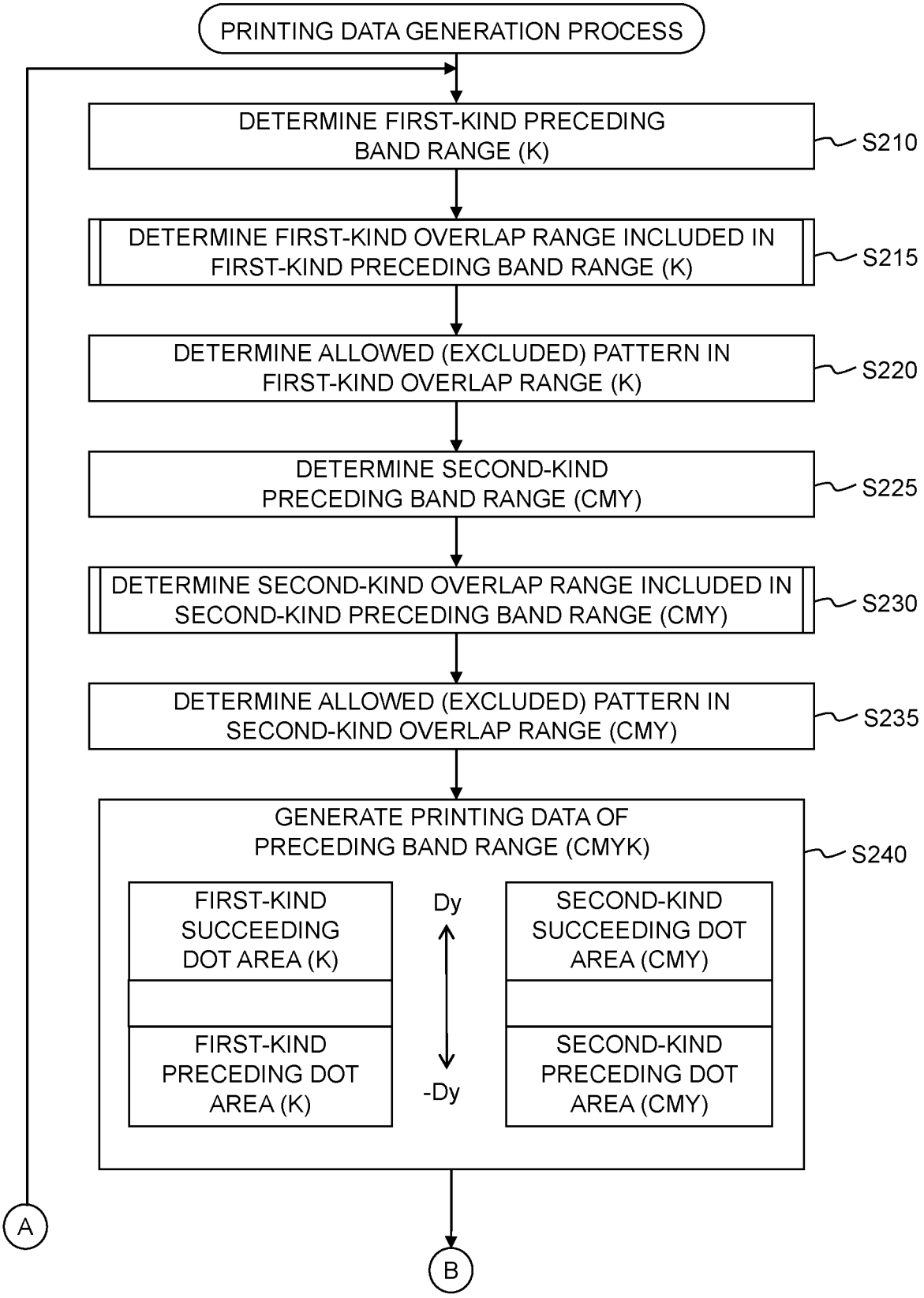
FIGS. 6A and 6B are a flowchart indicating an example of a printing data generation process.
Figure 6B:
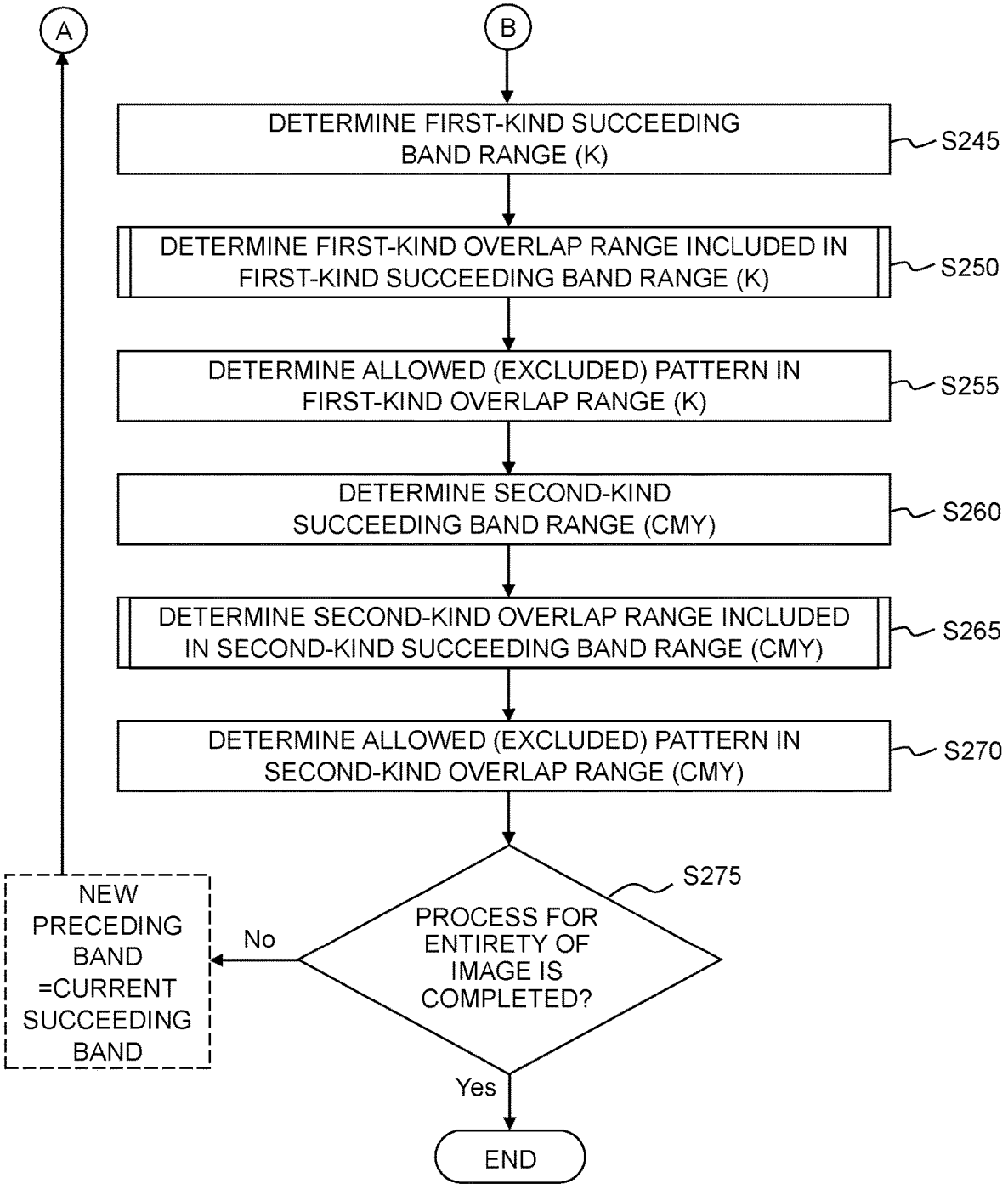

Referring to FIGS. 6A and 6B, an exemplary printing data generation process is explained. As explained in FIG. 4, the ranges in the sub-scanning direction Dy of two adjacent band images partially overlap with each other. Thus, the processor 210 selects the two adjacent band images as an object band pair that include band images to be processed. In the following, from among the two band images to be processed, a band image positioned at the upstream side (+ side in the Dy direction) is referred to as a "preceding band image" or simply referred to as a "preceding band". A band image positioned at the downstream side (− side in the Dy direction) is referred to as a "succeeding band image" or simply referred to as a "succeeding band". Further, as explained in FIG. 4, the band images are printed sequentially from the upstream side (+ side in the Dy direction) toward the downstream side (− side in the Dy direction). Thus, the processor 210 repeats the processes of S210 to S270 for the object band pair by moving the object band pair from the upstream side (+ side in the Dy direction) toward the downstream side (− side in the Dy direction) by one band each.

In S210, the processor 210 determines the first-kind preceding band range that is a range in the sub-scanning direction Dy of the first-kind preceding band image, which is the preceding band image of the black K. In the example of FIG. 4, in S210 performed for the first time, the first-kind preceding band range is determined as the first range R1 of the first band image BI1. In S210 performed for the second time, the first-kind preceding band range is determined as the second range R2 of the second band image BI2, which is adjacent to the first range R1 at the downstream side. The dot data (i.e., object image OD may include a blank area. When a range that is included in the preceding band range and includes an end at the upstream side (+ side in the Dy direction) of the preceding band range is configured only by the blank area, the processor 210 moves the preceding band range to the downstream side (− side in the Dy direction) by skipping the blank area. For example, when the preceding band range is the second range R2 and when a range BR that is included in the second range R2 and includes an end at the upstream side (+ side in the Dy direction) of the second range R2 is configured only by the blank area, the processor 210 moves the preceding band range from the second range R2 to a corrected second range R2*x* that is adjacent to the downstream side (− side in the Dy direction) of the blank range BR.

Figure 7:
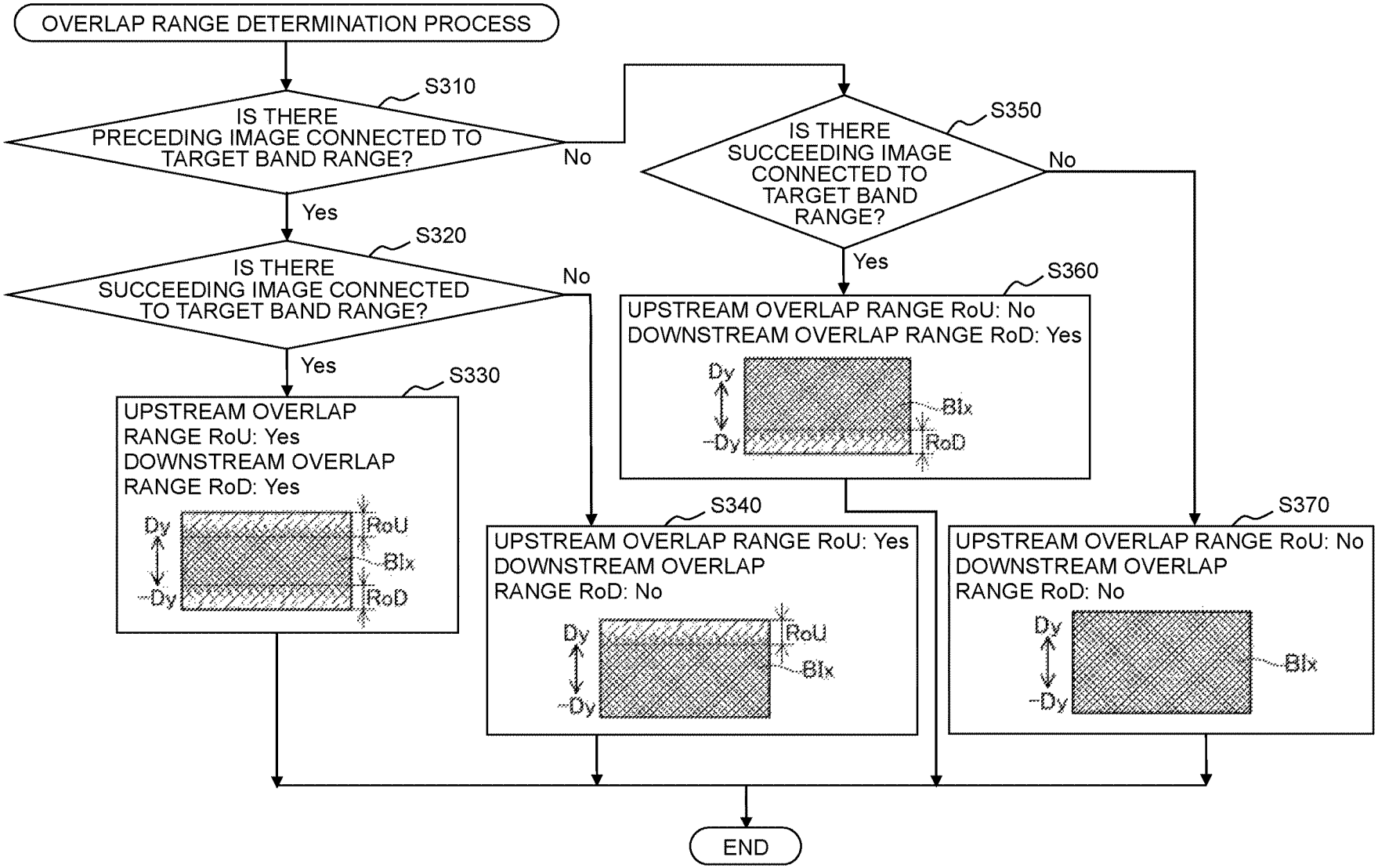
FIG. 7 is a flowchart indicating an example of an overlap range determination process.

In S215, the processor 210 determines the first-kind overlap range that is included in the first-kind preceding band range and is an overlap range at the downstream side (− side in the Dy direction). Referring to FIG. 7, explanation is made about an example of an overlap range determination process. The process of FIG. 7 is common to a variety of band ranges without being limited to the first-kind preceding band range, as described below. In the following, a band range to be processed in FIG. 7 is referred to as a target band range. A band image corresponding to the target band range is also referred to as a target band image.

In the process of FIG. 7, whether an upstream overlap range is to be provided and whether a downstream overlap range is to be provided are determined. The upstream overlap range is positioned at the upstream side (+Dy) of the target band range. The downstream overlap range is positioned at the downstream side (−Dy) of the target band range. When part of the image to be printed is adjacent to the upstream side (+Dy) of the target band range, the upstream overlap range is preferably provided to inhibit the failure in a color to be printed at a boundary between the target band image and an image at the upstream side (also referred to as a preceding image). When there is no preceding image, the upstream overlap range is preferably omitted. In that case, all the dots in the range corresponding to the upstream overlap range are printed when the target band image is printed. This improves printing velocity. The downstream side (−Dy) of the target band range is determined similarly to the upstream side (+Dy).

Specifically, the processor 210 refers to the dot data and determines whether the preceding image, which is connected to the upstream side (+Dy) of the target band range, is included in the object image OI (S310). When the preceding image is included in the object image OI (S310: YES), the processor 210 refers to the dot data and determines whether a succeeding image, which is connected to the downstream side (−Dy) of the target band range, is included in the object image OI (S320). When the succeeding image is included in the object image OI (S320: Yes), the processor 210 determines that the upstream overlap range and the downstream overlap range are to be provided (S330). A target band range BIx, an upstream overlap range RoU, and a downstream overlap range RoD are indicated in a box of S330. In this embodiment, the overlap ranges RoU and RoD have the same size and the size thereof is determined in advance. The processor 210 determines the overlap ranges RoU and RoD corresponding to the target band range BIx, and ends the process of FIG. 7.

When the processor 210 has determined that the succeeding image is not included in the object image OI (S320: No), the processor 210 determines that the upstream overlap range RoU is to be provided and the downstream overlap range RoD is not to be provided (S340). The processor 210 determines the upstream overlap range RoU corresponding to the target band range BIx, and ends the process of FIG. 7.

When the processor 210 has determined that the preceding image is not included in the object image OI (S310: No), the processor 210 determines whether the succeeding image is included in the object image OI (S350). The process of S350 is the same as the process of S320.

When the processor 210 has determined that the succeeding image is included in the object image OI (S350: Yes), the processor 210 determines that the upstream overlap range RoU is not to be provided and the downstream overlap range RoD is to be provided (S360). The processor 210 determines the downstream overlap range RoD corresponding to the target band range BIx, and ends the process of FIG. 7.

When the processor 210 has determined that the succeeding image is not included in the object image OI (S350: No), the processor 210 determines that neither the upstream overlap range RoU nor the downstream overlap range RoD are provided (S370). The processor 210 determines that the overlap range corresponding to the target band range BIx is not to be provided and ends the process of FIG. 7.

After the process of FIG. 7 (i.e., the process of S215 in FIG. 6A), the processor 210 determines the first-kind preceding allowed pattern in the first-kind overlap range determined in S215 (i.e., the overlap range at the downstream side (−Dy) of the first-kind preceding band range). The first-kind preceding allowed pattern is an arrangement pattern of pixels for which dots can be formed in printing of the first-kind preceding band image.

Figure 8:
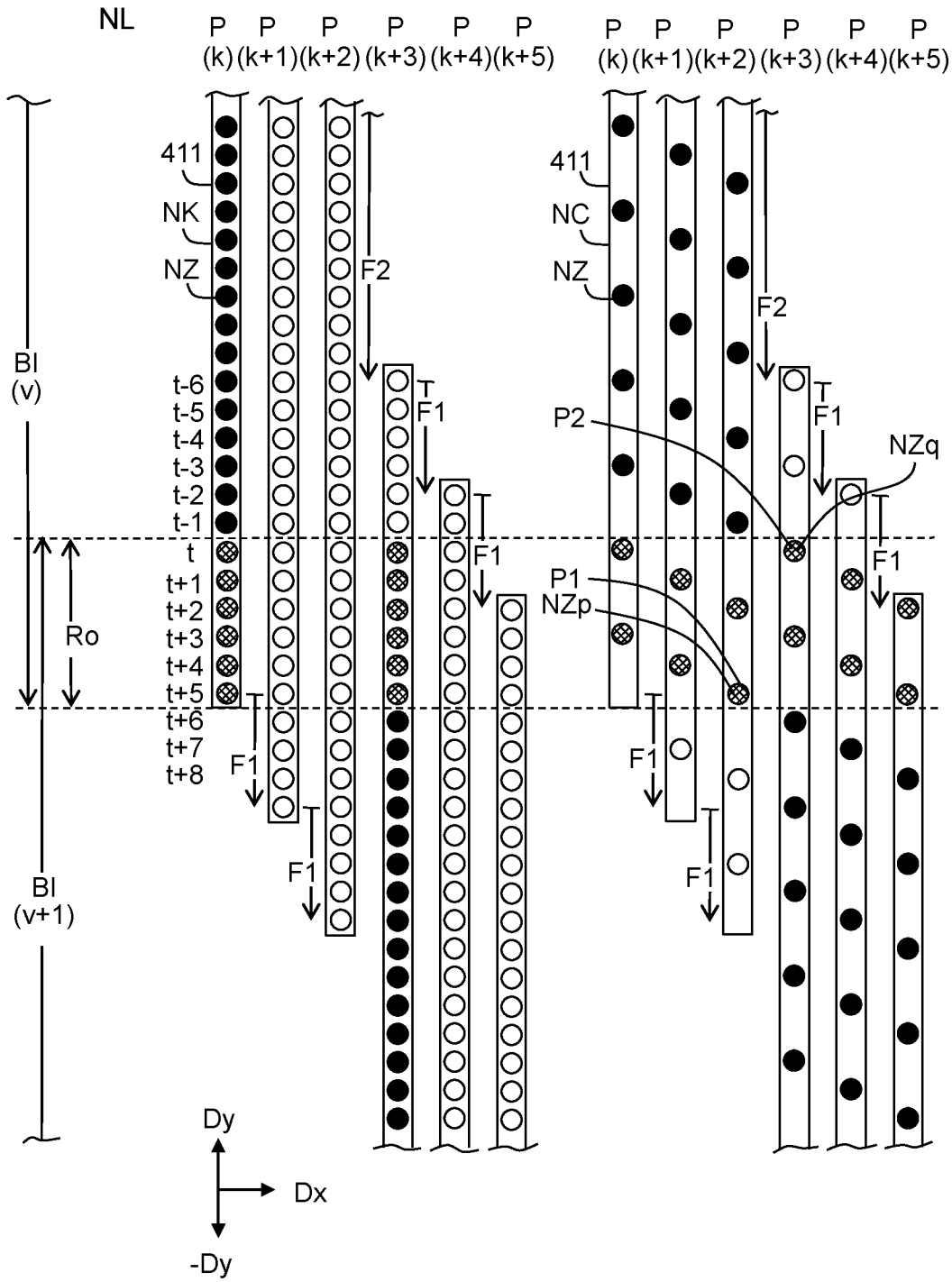
FIG. 8 is an illustrative view of nozzle positions and passes used for printing of the overlap range.

Referring to FIG. 8, explanation is made about passes to be used for printing of the overlap range and positions in the sub-scanning direction Dy of the nozzles. In FIG. 8, a horizontal direction is the main scanning direction (direction parallel to the Dx direction) and a vertical direction is the sub-scanning direction Dy. FIG. 8 depicts the v-th (v is an integer) band image BI(v), the (v+1)-th band image BI(v+1), and ranges in the sub-scanning direction Dy of those images. The overlap range Ro is a range where the band image BI(v) overlaps with the band image BI(v+1). FIG. 8 depicts positions in the sub-scanning direction Dy of nozzle groups NK and NC corresponding to six passes P(k) to P(k+5), namely the k-th pass (k is an integer) to the (k+5)-th pass. The nozzle group NK of the black K is depicted on the left side, and the nozzle group NC of the cyan C is depicted on the right side. Circles, in particular, black circles, white circles, and hatched circles each indicate the nozzle NZ.

Although not depicted in the drawings, the printing pixels are arranged lattice-likely along the main scanning direction (direction parallel to the Dx direction) and the sub-scanning direction Dy. In FIG. 8, the (t−6)-th to the (t+8)-th (t is an integer) each indicate a line number NL. The line number NL is an identification number of a printing pixel line extending in the main scanning direction. The line numbers NL are allocated to the printing pixel lines in ascending order toward the −Dy direction. In the example of FIG. 8, six pixel lines from the t-th line to the (t+5)-th line form the overlap range Ro.

In this embodiment, a resolution of printing pixels in the sub-scanning direction Dy is the same as a resolution (i.e., pitch NPa) in the sub-scanning direction Dy of the nozzles NZ of the black K. Thus, when the second nozzle pitch NPb of the nozzles NZ of a color ink (e.g., cyan C) is indicated by the number of printing pixels, the second nozzle pitch NPb is the same as F (in this embodiment, F=3). The nozzles NZ of the cyan C are arranged at a rate of one for every F pixels arranged in the sub-scanning direction Dy.

It is possible to perform printing of one printing pixel line that extends in the main scanning direction by use of one nozzle NZ through one pass. All the dots of one printing pixel line are performed using the nozzles NZ corresponding to the black circles. Ink dots are not formed by the nozzles NZ corresponding to the white circles. Dots are formed for one or more printing pixels included in the printing pixels of the corresponding printing pixel line by use of the hatched nozzles NZ. As described below, the v-th band image BI(v) is printed by three passes P(k) to P(k+2). The (v+1)-th band image BI(v+1) is printed by subsequent three passes P(k+3) to P(k+5). The overlap range Ro is printed by six passes P(k) to P(k+5).

The cyan C is explained first. Conveyance is performed twice during the three passes for printing one band image. The first conveyance amount F1 in FIG. 8 is a conveyance amount for one time. The first conveyance amount F1 and the nozzle pitch NPb of the cyan C indicated by the number of pixels are relatively prime (in the example of FIG. 8, NPb=F=3, F1=4). Thus, it is possible to form dots for mutually different pixel lines by use of the nozzle group NC of the cyan C through three passes. The number of times of passes (three times) is the same as the nozzle pitch NPb indicated by the number of pixels. Thus, it is possible to form dots for pixel lines, which continue in the sub-scanning direction Dy, by use of the nozzle group NC through three passes without a gap. In this embodiment, pixel lines not included in the overlap range are printed by use of the nozzle group NC through three passes (one pixel line is printed through one pass).

For the overlap range Ro, all the pixel lines are printed by two passes. For example, dots of the cyan C for the (t+1)-th pixel line are printed by the pass P(k+1) and the pass P(k+4). The second conveyance amount F2 in FIG. 8 is a conveyance amount between the last pass P(k+2) for the band image BI(v) and the first pass P(k+3) for the band image BI(v+1). The second conveyance amount F2 and the overlap range Ro are determined so that all the pixel lines of the overlap range Ro can be printed by two passes.

As described above, the pixel lines that continue in the sub-scanning direction Dy can be printed by the nozzle group NC through the same number of times of passes as the nozzle pitch NPb indicated by the number of pixels. However, an area overlapping with an end of the nozzle group NC includes a pixel line that can not be printed. For example, in the example of FIG. 8, the (t+6)-th pixel line at the −Dy side of the nozzle NZp in the pass P(k+2) can not be printed by three passes P(k) to P(k+2). At the + side in the Dy direction from the first position P1 of the nozzle NZp, it is possible to continuously print pixel lines by three passes P(k) to P(k+2). Similarly, the (t−1)-th pixel line at the +Dy side corresponding to the nozzle NZq for the pass P(k+3) can not be printed by three passes P(k+3) to P(k+5). At the − side in the Dy direction from the second position P2 of the nozzle NZq, it is possible to continuously print pixel lines by three passes P(k+3) to P(k+5).

In the example of FIG. 8, the second conveyance amount F2 is determined to satisfy the following first condition.

(First Condition)

The first position P1 in the sub-scanning direction Dy of the nozzle NZp corresponding to the pass (k+2) is at the −Dy side of the second position P2 in the sub-scanning direction Dy of the nozzle NZq corresponding to the pass P(k+3).

When the first condition is satisfied, all the pixel lines in the overlap range Ro are printed by two passes by adopting at least part of a range from the first position P1 to the second position P2 as the overlap range Ro. In this embodiment, the second conveyance amount F2 is determined to further satisfy the second and third conditions.

(Second Condition)

The total number (six in FIG. 8) of the pixel lines included in the range from the first position P1 to the second position P2 is an integral multiple (three in FIG. 8) of the nozzle pitch NPb indicated by the number of pixels.

(Third Condition)

An entirety of the range from the first position P1 to the second position P2 is adopted as the overlap range Ro.

When the above conditions are satisfied, arrangement of the nozzles NZ at the upstream side (+ side in the Dy direction) of the overlap range Ro corresponding to preceding three passes P(k) to P(k+2) is symmetrical to arrangement of the nozzles NZ at the downstream side (− side in the Dy direction) of the overlap range Ro corresponding to subsequent three passes P(k+3) to P(k+5). Accordingly, in each of the preceding three passes P(k) to P(k+2) and the succeeding three passes P(k+3) to P(k+5), corresponding relationships between pixel lines and passes for printing the pixel lines can be determined in accordance with a similar rule. For example, the (t−1)-th pixel line adjacent to the upstream side of the overlap range Ro is printed by the last pass P(k+2) included in the three passes of the k-th pass to the (k+2)-th pass. The (t+6)-th pixel line adjacent to the downstream side of the overlap range Ro is printed by the first pass P(k+3) included in the three passes of the (k+3)-th pass to the (k+5)-th pass.

The explanation about the cyan C described above is true of the magenta M and the yellow Y.

Subsequently, the black K is explained. In this embodiment, dots of the black K of each band image are printed by the first pass included in three passes. For example, dots of the black K of the v-th band image BI(v) are printed by the k-th pass P(k). No dots of the black K are formed by subsequent two passes P(k+1) and P(k+2). Dots of the black K of the (v+1)-th image BI(v+1) are printed by the (k+3)-th pass P(k+3). No dots of the black K are formed by subsequent two passes P(k+4) and P(k+5). Dots of the black K of the pixel line not included in the overlap range are printed by one pass. Dots of the black K of the pixel line included in the overlap range Ro are printed by the pass P(k) and the pass P(k+3).

As described above, in the example of FIG. 8, all the pixel lines in the overlap range Ro are printed by two passes for all of the inks of CMYK. It is thus possible to inhibit failure (e.g., white streaks and density unevenness) in colors to be printed in the overlap range Ro. The nozzles NZ that are included in the nozzles NZ belonging to the nozzle groups NK and NC and are positioned outside the overlap range Ro, are not used for printing. For example, in the pass P(k+1), the nozzles NZ of the black K corresponding to the (t+6)-th pixel line to the (t+8)-th pixel line are not used for printing. Typically, the nozzle NZ positioned at the end of each nozzle group is more greatly affected by a positional shift, such as vibration of the head unit 410, than the nozzles NZ positioned at a center portion of each nozzle group. In this embodiment, dots are inhibited from being formed by the nozzle NZ positioned at the end of each nozzle group. It is thus possible to inhibit failure in colors to be printed (e.g., white streaks and density unevenness) that may otherwise be caused by the positional shift of the head unit 410.

Figure 9A:
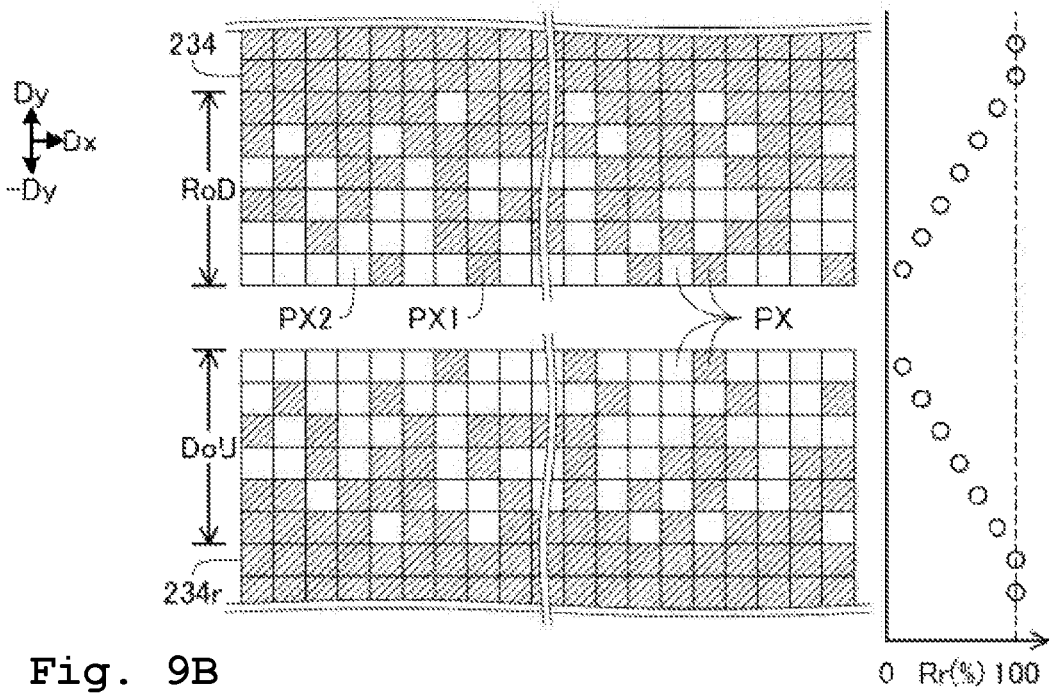
FIG. 9A illustrates the first mask data.
Figure 9B:
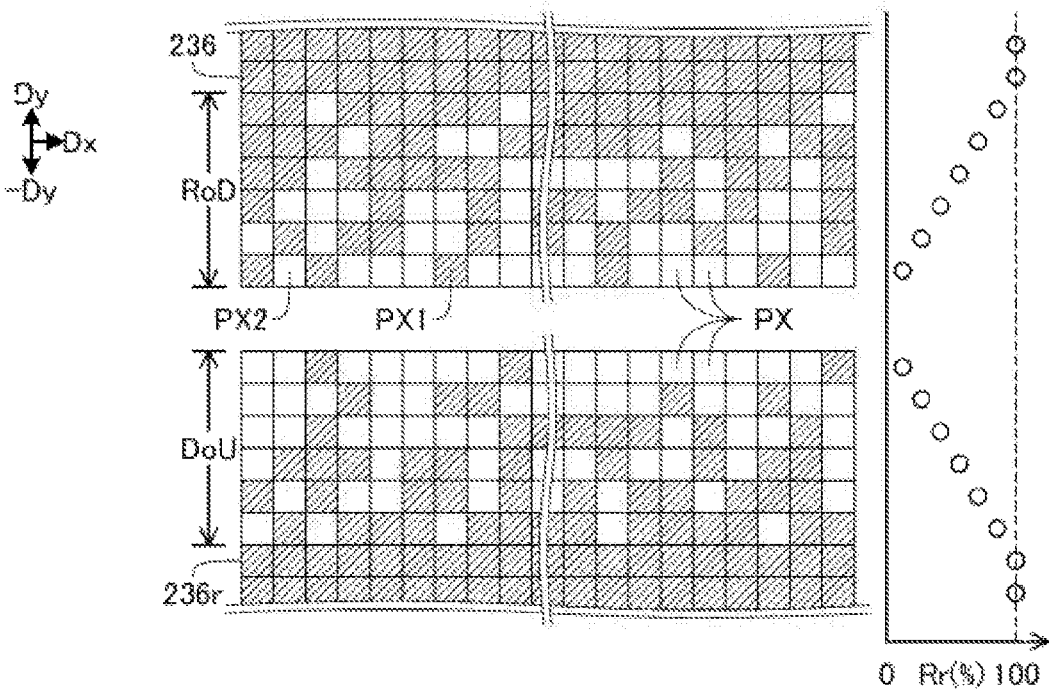
FIG. 9B illustrates the second mask data.

Correspondence relationships between dots of pixel lines in the overlap range and passes are defined by the first mask data 234 depicted in FIG. 9A and the second mask data 236 depicted in FIG. 9B. FIG. 9A depicts pixels PX of the downstream overlap range RoD at the downstream side (−Dy) of the band range. The hatched pixels PX1 indicate pixels for which dot formation is allowed (referred to as allowed pixel PX1). Blank pixels PX2 indicate pixels that are excluded from dot formation candidates (referred to as excluded pixels PX2). The first mask data 234 indicates an arrangement pattern of the pixels PX1 and PX2. The pixels in the downstream overlap range RoD are classified into the allowed pixels PX1 or the excluded pixels PX2. The arrangement pattern of the pixels PX1 and PX2 is determined in advance. In a right portion of FIG. 9A, a recording ratio Rr for each pixel line extending in the main scanning direction (direction parallel to the Dx direction) is depicted. The recording ratio Rr is a ratio of the total number of allowed pixels PX1 to the total number of pixels PX of one pixel line. In the overlap range Ro, the recording ratio Rr is smaller toward the downstream side (−Dy), as depicted in FIG. 9A. Namely, the recording ratio Rr is lower toward the end of the band area.

An arrangement pattern 234*r* of the pixels PX1 and PX2 in the upstream overlap range RoU at the upstream side (+Dy) side of the band range is depicted in a lower portion of FIG. 9A. The arrangement pattern 234*r* is the same as a pattern in which the allowed pixels PX1 and the excluded pixels PX2 in the arrangement pattern of the first mask data 234 are reversed (hereinafter, referred to as the first reverse pattern 234*r*).

In this embodiment, the first mask data 234 indicates the first-kind preceding allowed pattern that is an arrangement pattern of the allowed pixels PX1 for which dots of the black K can be formed. In S220 (FIG. 6A), the processor 210 determines the first-kind preceding allowed pattern in the overlap range at the downstream side (−Dy) of the first-kind preceding band range by referring to the first mask data 234. The first mask data 234 classifies the pixels into the two kinds of pixels including the allowed pixels PX1 and the excluded pixels PX2. Thus, determining the arrangement pattern of the allowed pixels PX1 is the same as determining the arrangement pattern of the excluded pixels PX2. Namely, it can be said that the processor 210 determines the arrangement pattern of the excluded pixels PX2 in S220.

When the processor 210 has determined in S215 that the overlap range at the downstream side (−Dy) is not to be provided, the processor 210 adopts an arrangement pattern in which all the pixels in the area corresponding to the overlap range are the allowed pixels PX1.

Figure 10:
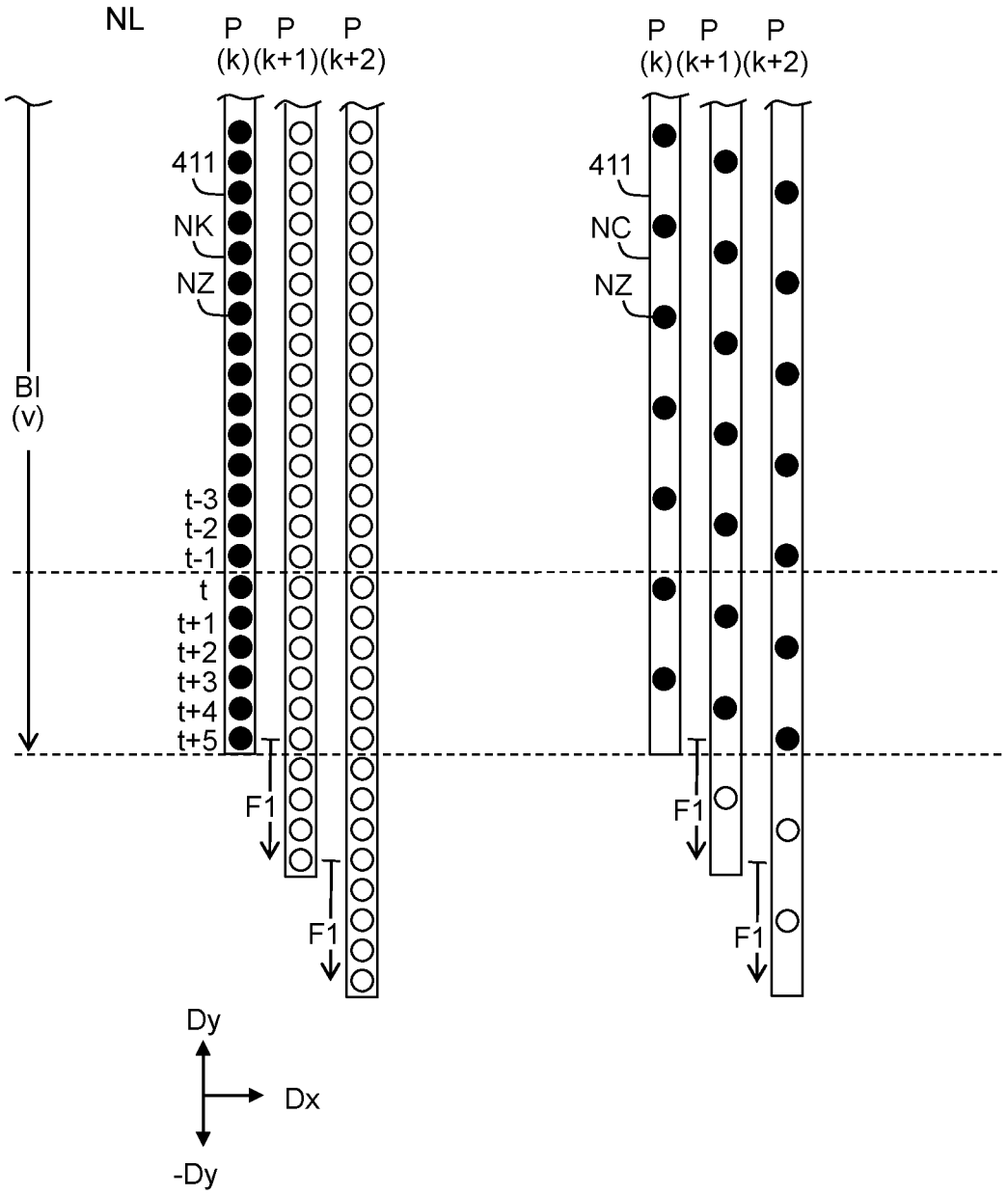
FIG. 10 is an illustrative view of passes and nozzle positions.

Referring to FIG. 10, explanation is made about passes and nozzle positions when the overlap range at the downstream side (−Dy) is not to be provided. FIG. 10 depicts a range of the band image BI(v) that is the same as FIG. 8 and an arrangement of the nozzle groups NK and NC corresponding to three passes P(k) to P(k+2). FIG. 10 depicts a case where the overlap range Ro (FIG. 8) at the downstream side (−Dy) of the band image BI(v) is not to be provided. In the t-th pixel line to the (t+5)-th pixel line corresponding to the overlap range Ro, dots of the black K are printed by the first pass P(k) included in the three passes, and dots of the cyan C are printed by the three passes P(k) to P(k+2) (one pixel line is printed by one pass).

Figure 11:
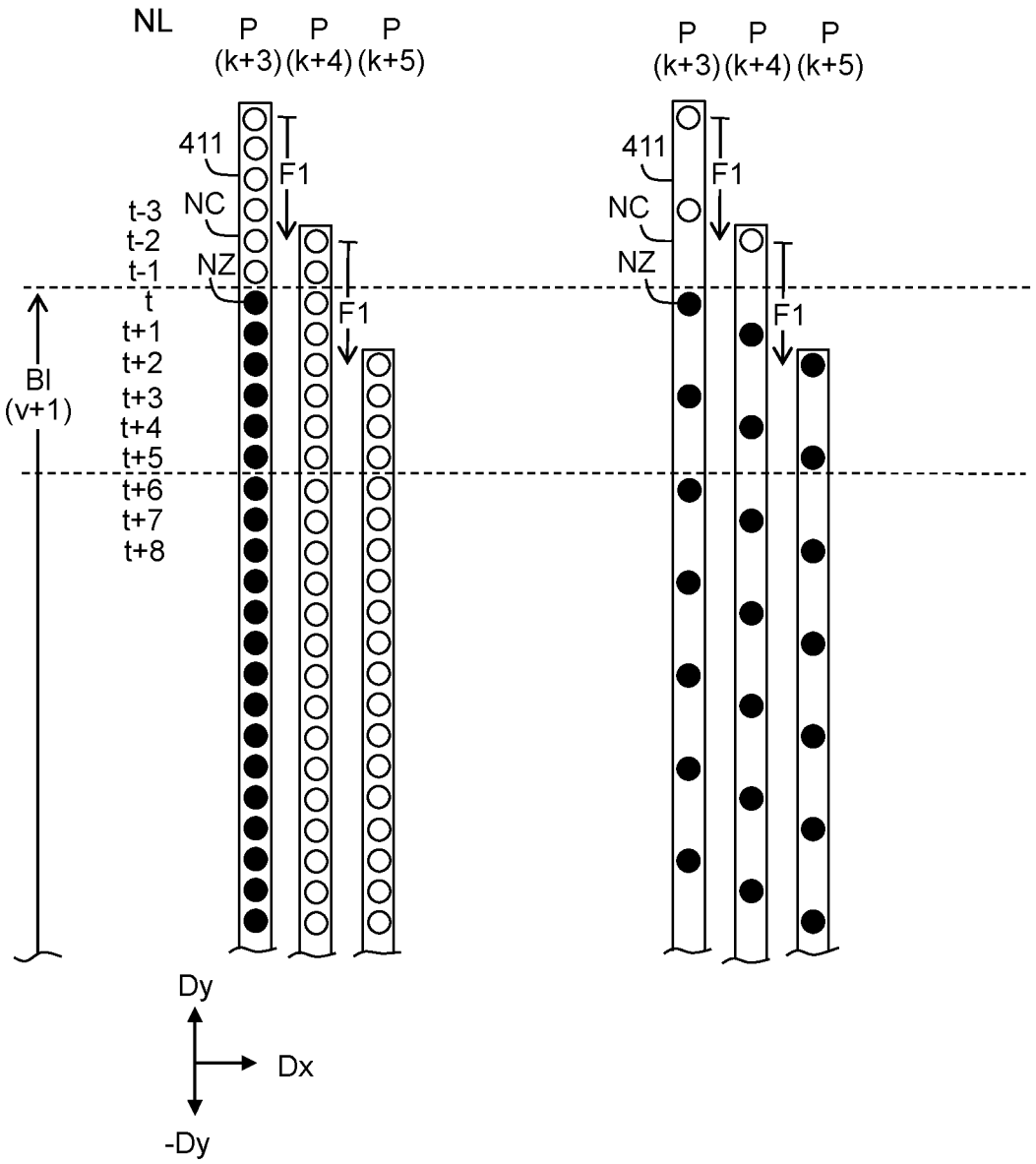
FIG. 11 is an illustrative view of passes and nozzle positions.

Referring to FIG. 11, explanation is made about passes and nozzle positions when the overlap range at the upstream side (+Dy) is not to be provided. FIG. 11 depicts a range of the band image BI(v+1) that is the same as FIG. 8 and an arrangement of the nozzle groups NK and NC corresponding to three passes P(k+3) to P(k+5). FIG. 11 depicts a case where the overlap range Ro (FIG. 8) at the upstream side (+Dy) of the band image BI(v+1) is not to be provided. In the t-th pixel line to the (t+5)-th pixel line corresponding to the overlap range Ro, dots of the black K are printed by the first pass P(k+3) included in the three passes, and dots of the cyan C are printed by the three passes P(k+3) to P(k+5) (one pixel line is printed by one pass).

The explanation about FIGS. 10 and 11 described above is true of the magenta M and the yellow Y. Accordingly, in this embodiment, the band range and the overlap range of the black (K) are the same as those of the color inks (CMY).

In S225 (FIG. 6A), the processor 210 determines the second-kind preceding band range that is a range in the sub-scanning direction Dy of the second-kind preceding band image, which is the preceding band image of the color inks (CMY). As described above, in this embodiment, the second-kind preceding band range is determined to have the same range as the first-kind preceding band range determined in S210.

In S230, the processor 210 determines the second-kind overlap range that is included in the second-kind preceding band range and is an overlap range at the downstream side (−Dy). In S230, similar to S215, the second-kind overlap range is determined in accordance with the flowchart of FIG. 7. In this embodiment, the second-kind overlap range is the same as the first-kind overlap range in S215. In S235, the processor 210 determines the second-kind preceding allowed pattern, which is an arrangement pattern of pixels for which dots can be formed in printing of the second-kind preceding band image, in the second-kind overlap range determined in S230 (i.e., the overlap range at the downstream side (−Dy) of the second-kind preceding band range).

Referring to FIG. 9B, the second mask data 236 is explained. The second mask data 236 is different in the arrangement pattern of the allowed pixels PX1 and the excluded pixels PX2 from the first mask data 234 depicted in FIG. 9A. In a right portion of FIG. 9B, a recording ratio Rr for each pixel line extending in the main scanning direction (direction parallel to the Dx direction) is depicted. In the downstream overlap range RoD, the recording ratio Rr is smaller toward the downstream side (−Dy), as depicted in FIG. 9B.

An arrangement pattern 236*r* of the pixels PX1 and PX2 of the upstream overlap range RoU at the upstream side (+Dy) of the band area is depicted in a lower portion of FIG. 9B. The arrangement pattern 236*r* is the same as a pattern in which the allowed pixels PX1 and the excluded pixels PX2 in the arrangement pattern of the second mask data 236 are reversed (hereinafter, referred to as the second reverse pattern 236*r*).

In this embodiment, the second mask data 236 indicates the second-kind preceding allowed pattern that is an arrangement pattern of the allowed pixels PX1 for which dots of the color inks (CMY) can be formed. In S235 (FIG. 6A), the processor 210 determines the second-kind preceding allowed pattern in the overlap range at the downstream side (−Dy) of the second-kind preceding band range by referring to the second mask data 236. Similar to S220, determining the arrangement pattern of the allowed pixels PX1 is the same as determining the arrangement pattern of the excluded pixels PX2. Namely, it can be said that the processor 210 determines the arrangement pattern of the excluded pixels PX2 in S235. When the processor 210 has determined in S230 that the overlap range at the downstream side (−Dy) is not to be provided, the processor 210 adopts the arrangement pattern in which all the pixels in the area corresponding to the overlap range are the allowed pixels PX1.

In S240, the processor 210 generates printing data of the preceding band range. The printing data indicates a distribution area of pixels where dots are to be formed (also referred to as dot pixels) for each of the CMYK, namely, a dot area where ink droplets are to be discharged. Further, the printing data defines correspondence relationships between dots and the passes.

Printing data of the black K is as follows. For a portion of the first-kind preceding band image that is not included in the overlap range, the processor 210 adopts the arrangement of the dots of the black K indicated by the dot data (FIG. 5: S170) as a distribution area of pixels for which dots of the black K are to be formed. When the processor 210 has determined in S215 that the overlap range at the upstream side (+Dy) or downstream side (−Dy) is not to be provided, for the omitted overlap range, the processor 210 adopts the arrangement of dots of the black K indicated by the dot data as the distribution area of pixels for which the dots of the black K are to be formed.

When the processor 210 has determined in S215 that the downstream overlap range at the downstream side (−Dy) is to be provided, for a portion included in the downstream overlap range, the processor 210 applies the first-kind preceding allowed pattern determined in S220 to the arrangement of dots of the black K indicated by the dot data. Accordingly, the processor 210 determines the first-kind preceding dot area, which is the distribution area of pixels for which dots of the black K are to be formed in printing of the first-kind preceding band image.

For the upstream overlap range at the upstream side (+Dy), the allowed pattern (also referred to as the first-kind succeeding allowed pattern) is determined in the process of S255 performed most recently among the processes of S210 to S270 performed repeatedly. The processor 210 determines the first-kind succeeding dot area, which is the distribution area of pixels for which dots of the black K are to be formed in printing of the first-kind preceding band image, by applying the first-kind succeeding allowed pattern to the dot data.

As described above, the processor 210 determines the distribution area of pixels for which dots of the black K are to be formed, over an entirety of the first-kind preceding band image. Further, the processor 210 determines the correspondence relationships between pixels and passes as explained in FIGS. 8, 10, and 11. The processor 210 determines the distribution area of pixels for which dots of the color inks (CMY) are to be formed, similar to the black K. For a portion included in the second-kind preceding band image and not included in the overlap range, the processor 210 adopts the arrangement of dots indicated by the dot data (FIG. 5: S170) as the distribution area of pixels for which dots are to be formed. When the processor 210 has determined in S230 that the downstream overlap range at the downstream side (−Dy) is to be provided, for a portion included in the downstream overlap range, the processor 210 adopts the second-kind preceding allowed pattern determined in S235 to the arrangement of dots indicated by the dot data. Accordingly, the processor 210 determines the second-kind preceding dot area, which is the distribution area of pixels for which dots are to be formed in printing of the second-kind preceding band image. For the upstream overlap range at the upstream side (+Dy), the allowed pattern is determined (also referred to as the second-kind succeeding allowed pattern) in the process of S270 performed most recently among the processes of S210 to S270 performed repeatedly. The processor 210 determines the second-kind succeeding dot area, which is the distribution area of pixels for which dots are to be formed in printing of the second-kind preceding band image, by applying the second-kind succeeding allowed pattern to the dot data. Further, the processor 210 determines the correspondence relationships between pixels and passes as explained in FIGS. 8, 10, and 11. Then, the processor 210 generates printing data for controlling the printing execution section 400 in accordance with the distribution areas of pixels for which dots of respective inks (CMYK) are to be formed and the correspondence relationships between the pixels and the passes.

In S245, the processor 210 determines the first-kind succeeding band range, which is a range in the sub-scanning direction Dy of the first-kind succeeding band image that is the succeeding band image of the black K. The first-kind succeeding band range is a band range adjacent to the downstream side (− side in the Dy direction) of the first-kind preceding band range. As explained in S210, the dot data (i.e., object image OI) may include the blank area. The processor 210 adjusts the succeeding band range so that the black area is skipped by the same method as the adjustment method of the position of the preceding band range in S210.

In S250, the processor 210 determines the first-kind overlap range that is included in the first-kind succeeding band range and is an overlap range at the upstream side (+Dy). The processor 210 determines the first-kind overlap range at the upstream side (+Dy) in accordance with the flowchart of FIG. 7.

In S255, for the first-kind overlap range determined in S250 (i.e., the overlap range at the upstream side (+Dy) of the first-kind succeeding band range), the processor 210 determines the first-kind succeeding allowed pattern, which is an arrangement pattern of pixels for which dots can be formed in printing of the first-kind succeeding band image. The processor 210 determines the first reverse pattern 234*r* by referring to the first mask data 234 (FIG. 9A), and adopts the first reverse pattern 234*r* as the first-kind succeeding allowed pattern. The first-kind succeeding allowed pattern determined in S255 is used in the process of S240 to be performed next among the processes of S210 to S270 performed repeatedly.

When the processor 210 has determined in S250 that the overlap range at the upstream side (+Dy) is not to be provided, the processor 210 adopts the arrangement pattern in which all the pixels in the area corresponding to the overlap range are the allowed pixels PX1.

In S260, the processor 210 determines the second-kind succeeding band range, which is a range in the sub-scanning direction Dy of the second-kind succeeding band image. The second-kind succeeding band image is the succeeding band image of color inks (CMY). As described above, in this embodiment, the second-kind succeeding band range is determined to have the same range as the first-kind succeeding band range determined in S245.

In S265, the processor 210 determines the second-kind overlap range that is included in the second-kind succeeding band range and is an overlap range at the upstream side (+Dy). In S265, similar to S250, the processor 210 determines the second-kind overlap range in accordance with the flowchart of FIG. 7. In this embodiment, the second-kind overlap range is the same as the first-kind overlap range of S250. In S270, for the second-kind overlap range determined in S265 (i.e., the overlap range at the upstream side (+Dy) of the second-kind succeeding band range), the processor 210 determines the second-kind succeeding allowed pattern which is the arrangement pattern of pixels for which dots can be formed in printing of the second-kind succeeding band image. The processor 210 determines the second reverse pattern 236*r* by referring to the second mask data 236 (FIG. 9B) and adopts the second reverse pattern 236*r* as the second-kind succeeding allowed pattern. The second-kind succeeding allowed pattern determined in S270 is used in the process of S240 to be performed next among the processes of S210 to S270 performed repeatedly. When the processor 210 has determined in S265 that the overlap range at the upstream side (+Dy) is not to be provided, the processor 210 adopts the arrangement pattern in which all the pixels in the area corresponding to the overlap range are the allowed pixels PX1.

In S275, the processor 210 determines whether the process for the entirety of the object image OI is completed. When a portion that is not yet processed remains (S275: No), the processor 210 proceeds to S210. The current succeeding band image is used as a new preceding band image.

When the process for the entirety of the object image OI is completed (S275: YES), the processor 210 ends the process of FIGS. 6A and 6B (i.e, the process of S180 in FIG. 5).

As described above, the multifunction peripheral 200 (FIGS. 1 and 2) includes the head unit 410, the moving device 430, the conveyor 440, and the controller 299. The head unit 410 includes the V pieces of (v is an integer equal to more than two) nozzle NZ of the black K, and the W piece(s) of (W is an integer equal to or more than one and less than V) nozzle NZ of the cyan C. The v-pieces of nozzle NZ of the black K have mutual different positions in the sub-scanning direction Dy, and from which black liquid droplets that are ink droplets of the black K are discharged. The w-piece(s) of nozzle NZ of the cyan C have mutual different positions in the sub-scanning direction Dy, and from which cyan liquid droplets that are ink droplets of the cyan C are discharged. The moving device 430 executes main scanning in which the head unit 410 moves in the main scanning direction (direction parallel to the Dx direction) perpendicular to the sub-scanning direction Dy with respect to the paper PM that is an exemplary recording medium. The conveyor 440 executes sub-scanning in which the paper PM is conveyed in the sub-scanning direction Dy with respect to the head unit 410. The controller 299 controls the head unit 410, the moving device 430, and the conveyor 440. Specifically, the controller 299 executes the forming process and the conveyance process a plurality of times. In the forming process, dots are formed by discharging liquid droplets on the paper PM during movement in the main scanning direction of the head unit 410. In the conveyance process, the paper PM is conveyed in the sub-scanning direction Dy.

In S240 of FIG. 6A, the processor 210 of the controller 299 generates the first printing data for forming the preceding band image by three forming processes. The first printing data includes data indicating an area of dot pixels (also referred to as the first-kind preceding dot area) for which liquid droplets of the black K are discharged, and an area of dot pixels (also referred to as the second-kind preceding dot area) for which liquid droplets of the cyan C are discharged. Further, the processor 210 repeats the processes of S210 to 270 (FIGS. 6A and 6B) for the object band pair while moving the object band pair toward the downstream side (−side in the Dy direction) by one band each. Thus, when the first printing data of the preceding band image is generated in S240, the second printing data of the succeeding band image (i.e., a new preceding band image) is generated in S240 to be performed next. The second printing data of the succeeding band image includes data indicating an area of dot pixels (also referred to as the first-kind succeeding dot area) for which liquid droplets of the black K are discharged, and an area of dot pixels (also referred to as the second-kind succeeding dot area) for which liquid droplets of the cyan C are discharged. Either case includes data indicating the first-kind preceding dot area, the second-kind preceding dot area, the first-kind succeeding dot area, and the second-kind succeeding dot area of the current preceding band image in S240 of this embodiment.

In S215 (FIG. 6A), the processor 210 determines the first-kind overlap range that is included in the preceding band range of the black K and is an overlap range at the downstream side (−Dy). The first-kind overlap range is a range where the preceding band range of the black K overlaps with the succeeding band range of the black K. In other words, the processor 210 is configured to control the head unit 410 to discharge the black droplets a plurality of times on the first-kind overlap range Ro which includes plurality of lines. Then, the processor 210 is configured to control the head unit 410 to discharge the black droplets on all of the lines for one movement in the main scanning direction. In S220, the processor 210 refers to the first mask data 234, and determines the arrangement pattern of the allowed pixels PX1 in the first-kind overlap range, in other words, the arrangement pattern of the excluded pixels PX2. The excluded pixels PX2 are pixels in the first-kind overlap range for which dots of the black K are not to be formed in printing of the preceding band image. The excluded pixels PX2 are not included in the first-kind preceding dot area.

In S230, the processor 210 determines the second-kind overlap range that is included in the preceding band range of the cyan C and is an overlap range at the downstream side (−Dy). The second-kind overlap range is a range where the preceding band range of the cyan C overlaps with the succeeding band range of the cyan C. In other words, the processor 210 is configured to control the head unit 410 to discharge the cyan droplets a plurality of times on the second-kind overlap range Ro which includes plurality of lines. Then, the processor 210 is configured to control the head unit 410 to discharge the cyan droplets on a part of the lines for one movement in the main scanning direction. More specifically, the plurality of lines include a first line and a second line. The second line is adjacent to the first line. The number W of the nozzles NZ of the cyan C have a preceding nozzle, a succeeding nozzle which is adjacent to the preceding nozzle in the sub-scanning direction and end nozzles which is arranged on both ends in the sub-scanning direction. The processor 210 is configured to control the head unit 410 to discharge the cyan droplets from the preceding nozzle to print the first line and from the succeeding nozzle to print the second line. The processor 210 is configured to control the conveyor 440 to convey the paper PM in the sub-scanning direction from a first position at which the preceding nozzle faces the first line to a second position at which the succeeding nozzle faces the second line after the head unit 410 has printed the first line and before the head unit 410 prints the second line. In other words, the controller 210 is configured to control the conveyor 430 to convey the paper PM in the sub-scanning direction by a first conveyance amount which is a conveyance amount for conveying the paper PM from the first position to the second position or a second conveyance amount greater than the first conveyance amount. Before the conveyor 430 conveys the paper PM by the second conveyance amount, the processor 210 is configured to control the head unit 410 to discharge the cyan droplets on the second second-kind overlap range Ro from the one of the end nozzles. In a case that the conveyor 430 conveys the paper PM by the first conveyance amount after the conveyor 430 conveys the paper PM by the second conveyance amount, the processor 210 is configured to control the head unit 410 to discharge the cyan droplets on the second-kind overlap range Ro from the other of the end nozzles. In S235, the processor 210 refers to the second mask data 236, and determines the arrangement pattern of the allowed pixels PX1 in the second-kind overlap range, in other words, the arrangement pattern of the excluded pixels PX2. The excluded pixels PX2 are pixels in the second-kind overlap range for which dots of the cyan C are not to be formed in printing of the preceding band image. The excluded pixels PX2 are not included in the second-kind preceding dot area.

In S255, the processor 210 refers to the first mask data 234 and determines, in the first-kind overlap range, the first reverse pattern 234*r* that is an arrangement pattern of pixels for which dots can be formed. The first-kind overlap range is an overlap range at the upstream side (+Dy) of the succeeding band range of the black K. The first reverse pattern 234*r* is an arrangement pattern of pixels for which dots can be formed in printing of the succeeding band image of the black K as well as an arrangement pattern of pixels for which dots can not be formed in printing of the preceding band image. The allowed pixels PX1 of the first reverse pattern 234*r* do not include the pixels for which dots can be formed in printing of the preceding band image. Then, in the next S240, the first-kind succeeding dot area for which dots of the black K can be formed is determined using the first reverse pattern 234*r* in accordance with the dot data.

In S270, the processor 210 refers to the second mask data 236, and determines, in the second-kind overlap range, the second reverse pattern 236*r* that is an arrangement pattern of pixels for which dots can be formed. The second-kind overlap range is an overlap range included in the succeeding band range of the cyan C and positioned at the upstream side (+Dy). The second reverse pattern 236*r* is an arrangement pattern of pixels for which dots can be formed in printing of the succeeding band image of the cyan C as well as an arrangement pattern of pixels for which dots can not be formed in printing of the preceding band image. Then, in the next S240, the second-kind succeeding dot area for which dots of the cyan C are to be formed is determined using the second reverse pattern 236*r* in accordance with the dot data.

As described above, the pixels for which dots are to be formed in printing of the preceding band image and the pixels for which dots are to be formed in printing of the succeeding band image are arranged in the overlap range of the black K, as depicted in FIG. 8 and FIG. 9A. The pixels for which dots are to be formed in printing of the preceding band image and the pixels for which dots are to be formed in printing of the succeeding band image are arranged in the overlap range of the cyan C, as depicted in FIG. 8 and FIG. 9B. In other words, the band image BI1 includes the overlap range Ro. The overlap range Ro overlaps with the band image BI2. Thus, even when the number V of nozzles NZ of the black K is different from the number W of the nozzles NZ of the cyan C, it is possible to inhibit the failure in colors to be printed (e.g., white streaks and density unevenness) in the overlap range.

The V-pieces of nozzle NZ of the black K are arranged in the sub-scanning direction Dy at the regular intervals, which are the first nozzle pitch NPa. The positions in the sub-scanning direction Dy of the W-piece(s) of nozzle NZ of the cyan C are arranged at the regular intervals, which are the second nozzle pitch NPb. The number V is F times (F is an integer equal to or more than two) the number W. The second nozzle pitch NPb is F times the first nozzle pitch NPa. Thus, as explained in FIG. 8, the printing resolution in the sub-scanning direction Dy of the cyan C is easily made to be the same as the printing resolution in the sub-scanning direction Dy of the black K. For example, it is possible to easily determine the first conveyance amount F1, the second conveyance amount F2, the size or dimension of the overlap range Ro, and the number of times of passes for printing of one band image. This makes it possible to appropriately form dots in the overlap range Ro by use of the plurality of kinds of inks.

As explained in FIG. 8, irrespective of the band image, the resolution in the sub-scanning direction Dy of dots of the cyan C is the same as the resolution in the sub-scanning direction Dy of dots of the black K. Namely, in S240 of FIG. 6A, the processor 210 generates the printing data of each band image so that the printing resolution in the sub-scanning direction Dy of the cyan C is the same as the printing resolution in the sub-scanning direction Dy of the black K. Thus, even when the number W of nozzles of the cyan C is small, it is possible to inhibit a situation in which the color of cyan C printed looks coarse. In this embodiment, the printing resolution in the main scanning direction is the same as the printing resolution in the sub-scanning direction Dy. However, the printing resolution in the main scanning direction may be different from the printing resolution in the sub-scanning direction Dy. The printing resolution in the main scanning direction may be determined for each ink.

As depicted in FIGS. 8, 10, and 11, when one band image is printed, the range in the sub-scanning direction Dy of the distribution area of the dot pixels of the black K is identical to the range in the sub-scanning direction Dy of the distribution area of dot pixels of the cyan C. The processor 210 generates the printing data of each band image to achieve such a relationship. Thus, printing of the band images can be performed without performing a complicated process due to the difference in the number of nozzles NZ.

As depicted in FIG. 8, in S215 and S230 (FIG. 6A), the processor 210 determines ranges so that the overlap range of the black K is the same as the overlap range of the cyan C. Thus, it is possible to inhibit a conspicuous difference between the overlap range of the black K and the overlap range of the cyan C.

In S220 of FIG. 6A, the processor 210 determines the arrangement pattern of the allowed pixels PX1 (i.e., the arrangement pattern of the excluded pixels PX2) by use of the first mask data 234 determined in advance. In S235, the processor 210 determines the arrangement pattern (i.e., the arrangement pattern of the excluded pixels PX2) of the allowed pixels PX1 by use of the second mask data 236 determined in advance. Thus, the processor 210 easily determines pixels for which dots are to be formed.

As depicted in FIGS. 9A and 9B, the pattern of the second mask data 236 is different from the pattern of the first mask data 234. Thus, it is possible to use the pattern suitable for the black K and the pattern suitable for the cyan C. For example, it is possible to inhibit interference between the pattern of the black K and the pattern of the cyan C.

Typically, the nozzle NZ positioned at the end of each nozzle group is more greatly affected by the positional shift, such as vibration of the head unit 410, than the nozzles NZ positioned at the center portion of each nozzle group. In this embodiment, as depicted in FIGS. 9A and 9B, the recording ratio Rr is lower toward the end of the band area, namely toward the end of the nozzle group. Thus, it is possible to improve robustness against unintended movement, such as the vibration of the head unit 410.

The explanation about the cyan C described above is true of the magenta M and the yellow Y.

[Second Embodiment]

Figure 12:
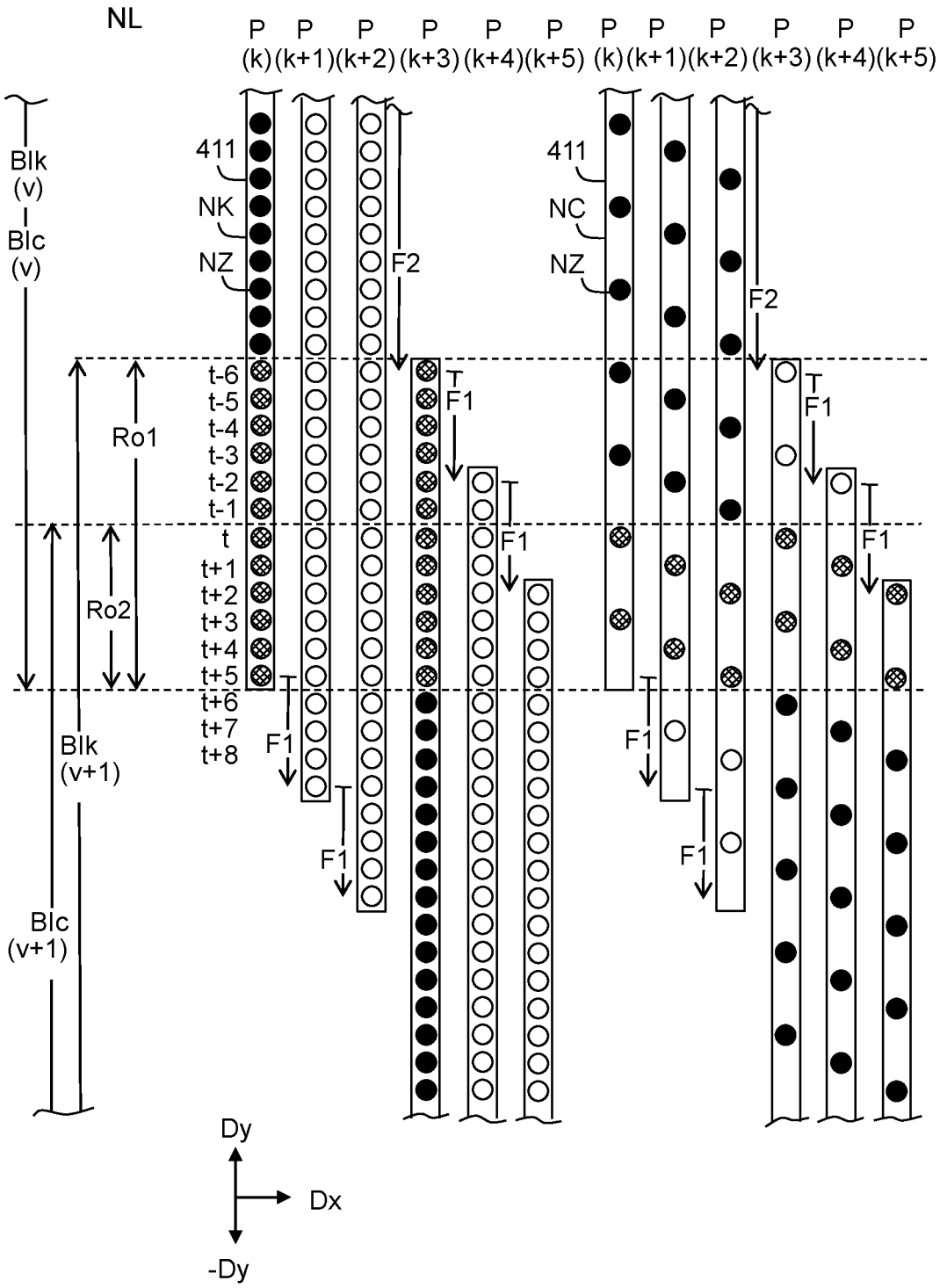
FIG. 12 is an illustrative view of relationships between passes and nozzles according to the second embodiment.

Referring to FIG. 12, explanation is made about relationships between passes and nozzles according to the second embodiment. FIG. 12 depicts six passes P(k) to P(k+5) that are the same as those in FIG. 8. The difference between FIG. 12 and FIG. 8 is that dots of the black K of six pixel lines from the (t−6)-th pixel line to the (t−1)-th pixel line are printed by the pass P(k) and the pass P(k+3). Thus, twelve pixel lines from the (t−6)-th pixel line to the (t+5)-th pixel line form the overlap range Ro1 of the black K. The overlap range Ro2 of the cyan C is the same as the overlap range in FIG. 8. The range in the sub-scanning direction Dy of the (v+1)-th band image BIk (v+1) that indicates an image by dots of the black K is expanded to include the overlap range Ro1 of the black K. The range in the sub-scanning direction Dy of the (v+1)-th band image BIc(v+1) that indicates an image by dots of the cyan C is the same as the range of the band image BI(v+1) in FIG. 8. The position of the downstream end (−Dy) of each band image of the black K is the same as that of the cyan C. In the example of FIG. 12, the pixel line at the downstream end (−Dy) of each of the band image BIk(v) of the black K and the band image BIc(v) of the cyan C is the (t+5)-th pixel line.

The overlap range Ro1 of the black K is larger than the overlap range Ro2 of the cyan C. This inhibits the failure of color to be printed using black K (e.g., white streaks and density unevenness) at the boundary between the band image BIk(v) and the band image BIk (v+1). The end at the upstream side (+Dy) of the band image BIc(v+1) that indicates an image by dots of the cyan C is the t-th pixel line. Accordingly, the range in the sub-scanning direction Dy of the band image of the black K (i.e., the range in the sub-scanning direction Dy of an area for which dots can be formed) may be different from that of the cyan C. In the second embodiment, the first mask data 234 for the overlap range Ro1 of the black K is configured so that pixels of twelve pixel lines are classified into the allowed pixels PX1 or the excluded pixels PX2. The explanation about the cyan C is true of the magenta M and the yellow Y.

[Third Embodiment]

Figure 13:
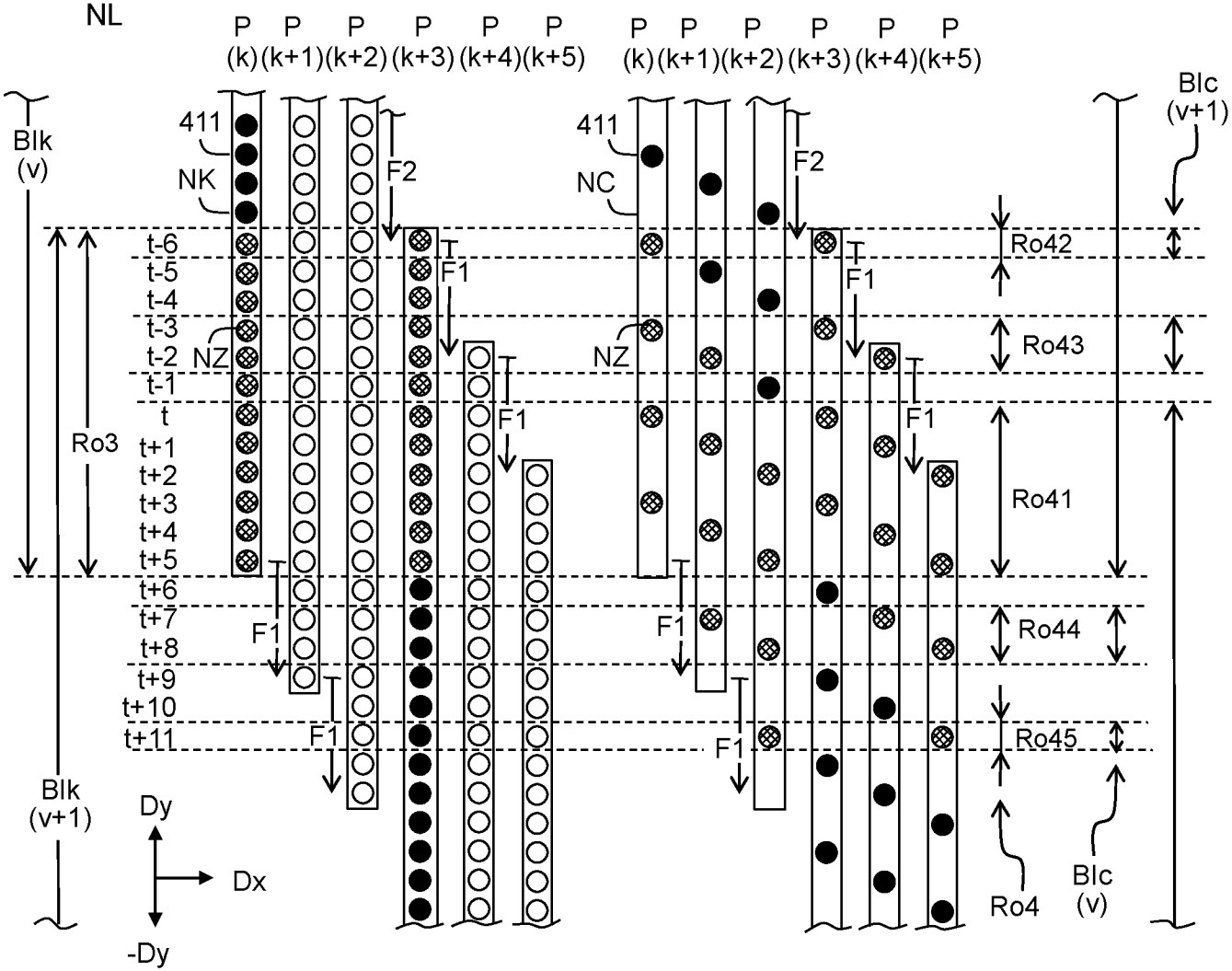
FIG. 13 is an illustrative view of relationships between passes and nozzles according to the third embodiment.

Referring to FIG. 13, explanation is made about relationships between passes and nozzles according to the third embodiment. FIG. 13 depicts six passes P(k) to P(k+5) that are the same as those in FIG. 12. The difference between FIG. 12 and FIG. 13 is that dots of the cyan C of six pixel lines including the (t−6)-th pixel line, the (t−3)-th pixel line, the (t−2)-th pixel line, the (t+7)-th pixel line, the (t+8)-th pixel line, and the (t+11)-th pixel line outside the overlap range Ro2 of the cyan C in FIG. 12 are printed by two passes. In this embodiment, the overlap range may not be one continuous range such as the overlap range Ro2 in FIG. 12. The overlap range may be an overlap range formed by ranges separated from each other. In particular, the overlap range Ro4 of the cyan C is formed by the first partial overlap range Ro41 that is the same as the overlap range Ro2 in FIG. 12, the second partial overlap range Ro42(*t*−6), the third partial overlap range Ro43(*t*−3, t−2), the third partial overlap range Ro44(*t*+7, t+8), and the fourth partial overlap range Ro 45(*t*+11). The overlap range may thus be formed by the partial overlap ranges. Also in this case, it is possible to inhibit the failure in colors to be printed (e.g., white streaks and density unevenness). The range in the sub-scanning direction Dy of the band image BIc(v) that indicates an image by dots of the cyan C includes not only pixel lines at the upstream side (+Dy) from the (t+5)-th pixel line but also the partial overlap ranges Ro44 and Ro45. Further, the range in the sub-scanning direction Dy of the band image BIc(v+1) that indicates an image by dots of the cyan C includes not only pixel lines at the downstream side (−Dy) from the t-th pixel line but also the partial overlap ranges Ro42 and Ro43. The overlap range Ro3 of the black K is the same as the overlap range Ro1 of the black K in FIG. 12. The ranges in the sub-scanning direction Dy of the band images BIk(v) and BIk(v+1) of the black K in FIG. 13 are the same as the ranges in the sub-scanning direction Dy of the band images BIk(v) and BIk(v+1) of the black K in FIG. 12, respectively. The explanation about cyan C is true of the magenta M and the yellow Y. The respective inks may have different overlap ranges.

[Fourth Embodiment]

Figures 14A, 14B, 14C:
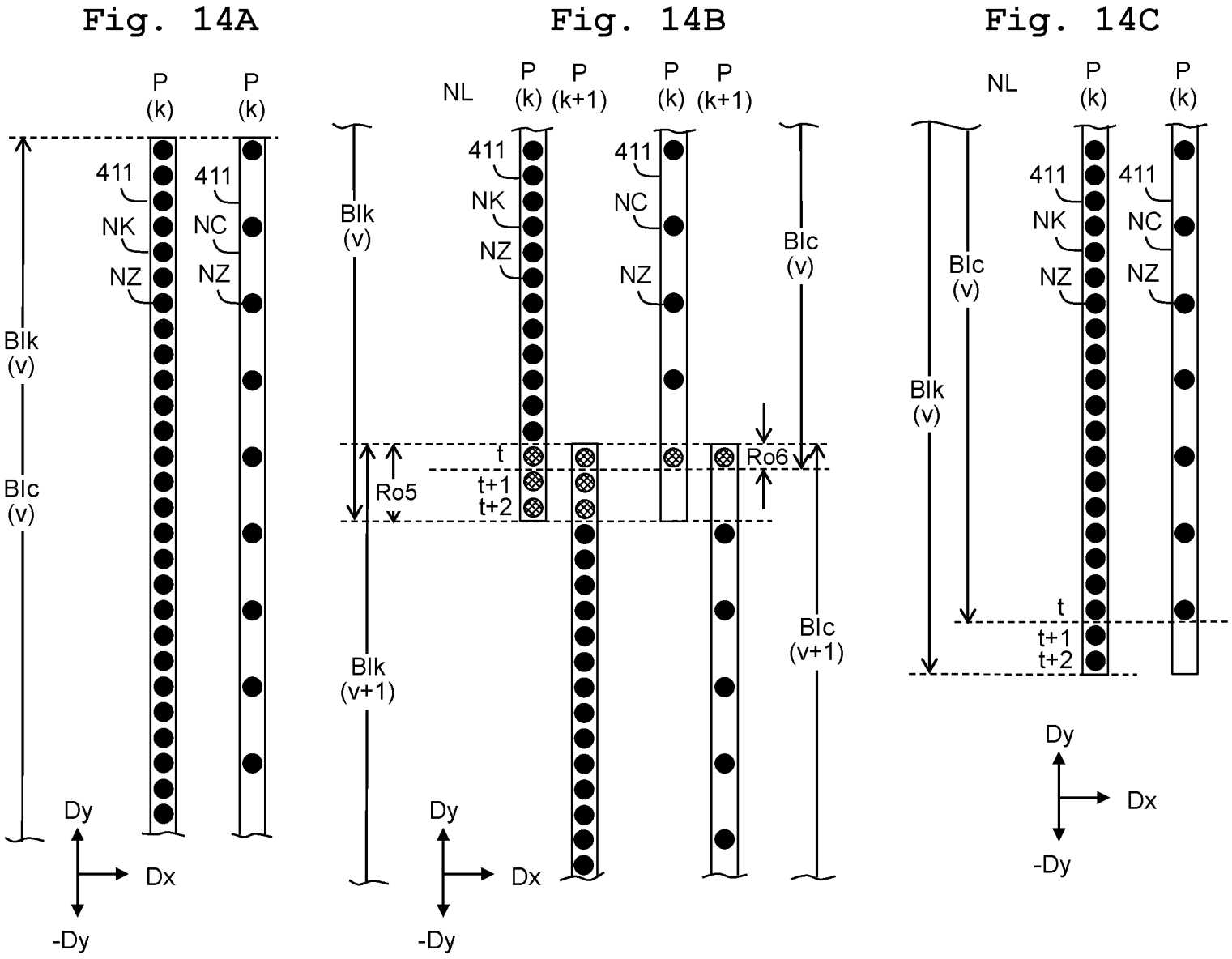
FIGS. 14A to 14C are illustrative views each depicting relationships between passes and nozzles according to the fourth embodiment.

Referring to FIGS. 14A to 14C, explanation is made about relationships between passes and nozzles according to the fourth embodiment. In the fourth embodiment, the printing resolution of the black K is different from the printing resolution of the cyan C. Specifically, the printing resolution in the sub-scanning direction Dy of the black K is the same as the resolution (first nozzle pitch NPa) in the sub-scanning direction Dy of the nozzles NZ of the black K. The printing resolution in the conveyance direction Dy of the cyan C is the same as the resolution (second nozzle pitch NPb) in the sub-scanning direction Dy of the nozzles NZ of the cyan C.

FIG. 14A illustrates relationships between passes and nozzles when the overlap range at the upstream side (+Dy) is not to be provided. FIG. 14A depicts the k-th pass P(k) and the ranges in the sub-scanning direction Dy of the band images BIk(v) and BIc(v) of the black K and the cyan C. As depicted in FIG. 14A, the pixel lines not included in the overlap range are printed by one pass P(k). The position of the upstream end (+Dy) of the band image BIk(v) of the black K is the same as the position of the upstream end (+Dy) of the band image BIc(v) of the cyan C. FIG. 14B illustrates relationships between passes and nozzles to be used for printing of the overlap range. FIG. 14B depicts the pass P(k), the pass P(k+1), and the ranges in the sub-scanning direction Dy of the band images BIk(v), BIk(v+1), BIc(v), and BIc(v+1) of the black K and the cyan C. The overlap range Ro5 of the black K is formed by three pixel lines from the t-th pixel line to the (t+2)-th pixel line. The three pixel lines of the overlap range Ro5 are printed by using three nozzles NZ at the downstream end (−Dy) of the black K corresponding to the pass P(k) and three nozzles NZ at the upstream end (+Dy) of the black K corresponding to the pass P(k+1). Regarding the cyan C, one pixel line that has the same position as the t-th pixel line of the black K forms the overlap range Ro6. This one pixel line is printed by one nozzle NZ at the downstream end (−Dy) of the cyan C corresponding to the pass P(k) and one nozzle NZ at the upstream end (+Dy) of the cyan C corresponding to the pass P(k+1). Regarding the v-th band image, the pixel line at the downstream end (−Dy) of the band image BIk(v) of the black K is the (t+2)-th pixel line. The pixel line at the downstream end (−Dy) of the band image BIc(v) of the cyan C has the same position as the t-th pixel line of the black K. Regarding the band images BIk(v+1) and BIc(v+1), the pixel lines at the upstream end (+Dy) are common to the black K and the cyan C, and correspond to the t-th pixel line. FIG. 14C illustrates relationships between passes and nozzles when the overlap range at the downstream side (−Dy) is not to be provided. FIG. 14C depicts the pass P(k) and the ranges in the sub-scanning direction Dy of the band images BIk(v) and BIc(v) of the black K and the cyan C. As depicted in FIG. 14C, the pixel line not included in the overlap range is printed by one pass P(k). When the pixel line at the downstream end (−Dy) of the band image BIk(v) of the black K is the (t+2)-th pixel line, the pixel line at the downstream end (−Dy) of the band image BIc(v) of the cyan C has the same position as the t-th pixel line of the black K. As described above, in this embodiment, areas other than the overlap ranges Ro5 and Ro6 are printed by one pass, and thus fast printing is possible. The sizes of the overlap ranges Ro5 and Ro6 may be an integral multiple of the size of the reference set NZb. The explanation about the cyan C is true of the magenta M and the yellow Y.

[Fifth Embodiment]

Figure 15:
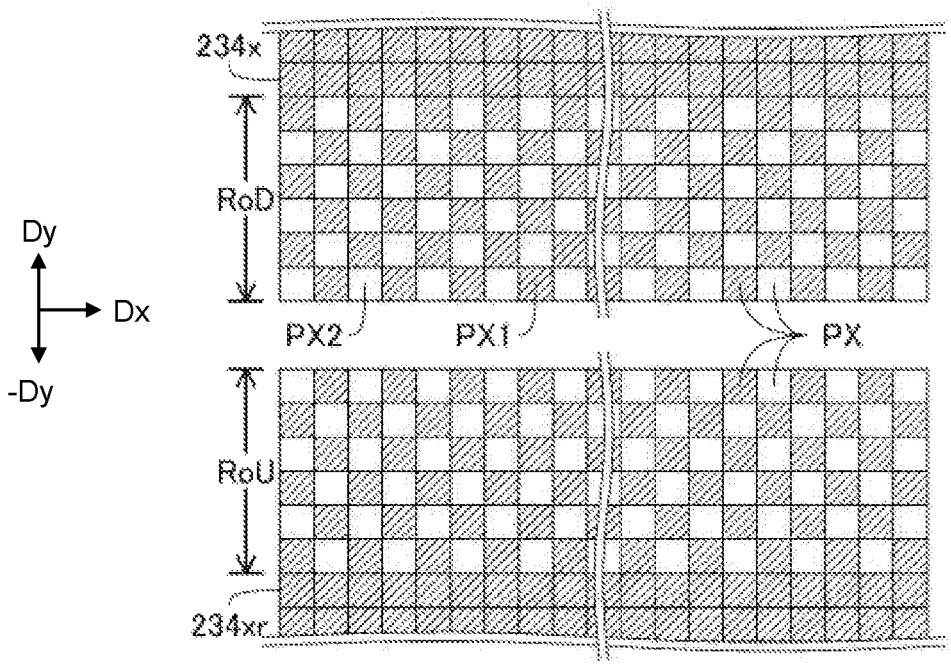
FIG. 15 illustrates mask data of the fifth embodiment.

Referring to FIG. 15, explanation is made about mask data according to the fifth embodiment. In the mask data 234*x* of this embodiment, unlike the first mask data 234 in FIG. 9A, the allowed pixels PX1 and the excluded pixels PX2 are arranged alternately along the two directions Dx and Dy. Instead of the first mask data 234 and the reverse pattern 234*r* in FIG. 9A, the mask data 234*x* and the reverse pattern 234*xr* may be used. As the second mask data 236, the same mask data 234*x* may be used. Or, mask data having another arrangement pattern (e.g., mask data obtained by reversing the allowed pixels PX1 and the excluded pixels PX2 of the mask data 234*x*) may be used instead of the second mask data 236. The arrangement pattern of the allowed pixels PX1 and the excluded pixel PX2 may be any other arrangement pattern. For example, the allowed pixels PX1 and the excluded pixels PX2 may be arranged in stripes. When the overlap range is formed by partial overlap ranges separated from each other, like the overlap range Ro4 of FIG. 13B, the mask data may determine the arrangement pattern of the allowed pixels PX1 and the excluded pixels PX2 in each of the partial overlap ranges. Typically, the mask data may determine the arrangement pattern of the allowed pixels PX1 and the excluded pixels PX2 among the pixels included in the overlap range. Further, instead of the arrangement pattern determined in advance, the processor 210 may determine the arrangement pattern of the allowed pixels PX1 and the excluded pixels PX2 by arithmetic operation such as random numbers. The respective inks (e.g., inks of the cyan C, the magenta M, and the yellow Y) may have mutually different arrangement patterns of the allowed pixels PX1 and the excluded pixels PX2.

[Modified Examples]

(1) The printing process may be any other process than the above process. For example, dots of the black K may be formed by the second or the third pass from among three passes for printing of one band image. One band image may be any image in which overlap ranges can be formed at the end in the +Dy direction and the end in the −Dy direction. The number of passes to be used for printing of one band image may be any number equal to more than one. The ratio of the number V of the nozzles NZ of the black K to the number W of the nozzles NZ of the nozzle group of each color (e.g., the nozzle group NC of the cyan C) may be different from the ratio of the second nozzle pitch NPb of each color (e.g., cyan C) to the first nozzle pitch NPa of the black K.

(2) The correspondence relationship between the conveyance amount and the pixel line and the nozzle by which dots for the pixel line are formed may be any other correspondence relationship than the correspondence relationship in each of the above embodiments. For example, the printing resolution in the sub-scanning direction Dy may be higher than the resolution (nozzle pitch) of the nozzle in the sub-scanning direction Dy of each of the nozzle groups. Also in this case, similar to the cyan C according to the embodiment depicted in FIG. 8, printing can be performed by passes at the printing resolution higher than the resolution of the nozzle.

(3) The printing process may be any other process than the process of FIG. 5. For example, the processes including S150 to S190 may be repeated for each band image.

(4) The configuration of the liquid droplet discharge apparatus may be any other configuration than the configuration depicted in each of FIGS. 1 to 3. For example, the ink supply section 450 may be secured to the carriage 433. The position in the sub-scanning direction Dy of the most upstream nozzles NZYu, NZCu, and NZMu of the CMY in FIG. 3 may be different from the position in the sub-scanning direction Dy of the most upstream nozzle NZKu of the black K. Instead of moving the head unit 410, the moving device 430 may move the head unit 410 in the main scanning direction relative to the recording medium by moving the recording medium such as the paper P. The recording medium is not limited to the paper, and may be any other medium such as cloth and film. The ink may be either a pigment ink or a dye ink. The ink may be an ultraviolet curable ink such as a UV ink, an ink containing an organic solvent such as a solvent ink, or an ink containing metal. Any other liquid than ink (e.g., molten resin) may be discharged from the nozzles. The combination of colors of inks usable for printing is not limited to CMYK, and a white ink, a transparent ink, or an ink having metallic luster may be used.

(5) The data processes included in the printing process (e.g., at least part of the processes including S110 to S180 of FIG. 5) may be executed by an external data processing apparatus (e.g., a personal computer, a digital camera, a scanner, and a smartphone) connected to the liquid droplet discharge apparatus, instead of the controller of the liquid droplet discharge apparatus such as the multifunction peripheral 200. Apparatuses (e.g., computers) that can communicate with each other via a network may share functions of the data processes by the data processing apparatus so that the entirety of the apparatuses that can communicate with each other can provide the functions of the data processes (a system provided with those apparatuses corresponds to the data processing apparatus).

In each of the above embodiments, part of the configuration achieved by hardware may be replaced by software, or part or all of the configuration(s) achieved by software may be replaced by hardware. For example, the processes of S150, S160, and S170 in FIG. 5 may be achieved by a dedicated hardware.

When part or all of the functions of the present disclosure is/are achieved by a computer program, the program may be provided by being stored in a computer-readable recording medium (e.g., non-transitory recording medium). The program may be used in a state of being stored in a recording medium (computer-readable recording medium) that is the same as or different from one in the case of being provided.

The "computer-readable recording medium" is not limited to a portable recording medium, such as a memory card and CD-ROM, and may include an internal storage in a computer such as a ROM and an external storage connected to a computer such as a hard disk drive.

The present disclosure is explained above based on the embodiments and the modified examples. The embodiments and the modified examples described above are provided to facilitate understanding of the present disclosure, and the present disclosure is not limited to those. The present disclosure may be changed or modified without departing from the gist and the scope of the claims below, and includes equivalents thereof.

What is claimed is:

1. A liquid droplet discharge apparatus, comprising:

a conveyor configured to convey a recording medium in a sub-scanning direction;

a head unit including first-kind nozzles and at least one second-kind nozzle, the first-kind nozzles having mutually different positions in the sub-scanning direction, each of the first-kind nozzles discharging first-kind liquid droplets, the first-kind liquid droplets being liquid droplets of a first liquid, the at least one second-kind nozzle discharging second-kind liquid droplets, the second-kind liquid droplets being liquid droplets of a second liquid, the number of the at least one second-kind nozzle is less than the number of the first-kind nozzles;

a moving device configured to move the head unit in a main scanning direction intersecting with the sub-scanning direction; and a controller, wherein the controller is configured to execute:

a first data generation process for generating a first data, the first data being used for forming a first image, the first data indicating a first-kind preceding dot area and a second-kind preceding dot area, the first-kind preceding dot area being an area in which the first-kind liquid droplets are to be discharged, the second-kind preceding dot area being an area in which the second-kind liquid droplets are to be discharged;

a second data generation process for generating a second data, the second data being used for forming a second image, the second data indicating a first-kind succeeding dot area and a second-kind succeeding dot area, the first-kind succeeding dot area being an area in which the first-kind liquid droplets are to be discharged, the second-kind succeeding dot area being an area in which the second-kind liquid droplets are to be discharged; and a forming process for forming dots by controlling the head unit, the moving device, and the conveyor based on the first data and the second data to discharge liquid droplets on the recording medium, the first-kind preceding dot area includes a first-kind overlap range, the first-kind overlap range overlapping with the first-kind succeeding dot area, and the second-kind preceding dot area includes a second-kind overlap range, the second-kind overlap range overlapping with the second-kind succeeding dot area.

2. The liquid droplet discharge apparatus according to claim 1, wherein the number of the first-kind nozzles is V (V is an integer equal to or more than two), the number of the at least one second-kind nozzle is W (W is an integer equal to or more than one and less than V), and the V indicating the number of the first-kind nozzles is F times (F is an integer equal to or more than two) the number W.

3. The liquid droplet discharge apparatus according to claim 2, wherein the F is three.

4. The liquid droplet discharge apparatus according to claim 2, wherein the head unit includes a plurality of second-kind nozzles as the at least one second-kind nozzle, the first-kind nozzles are arranged at a first pitch, the second-kind nozzles are arranged at a second pitch, and the second pitch is F times the first pitch.

5. The liquid droplet discharge apparatus according to claim 4, wherein the first-kind nozzles are arranged at regular intervals, and the second-kind nozzles are arranged at regular intervals.

6. The liquid droplet discharge apparatus according to claim 2, wherein the controller is configured to control the head unit to discharge the first-kind liquid droplets a plurality of times on the first-kind overlap range.

7. The liquid droplet discharge apparatus according to claim 6, wherein the first-kind overlap range includes a plurality of lines, and the controller is configured to control the head unit to discharge the first-kind liquid droplets on all of the lines for one movement in the main scanning direction.

8. The liquid droplet discharge apparatus according to claim 2, wherein the controller is configured to control the head unit to discharge the second-kind liquid droplets a plurality of times on the second-kind overlap range.

9. The liquid droplet discharge apparatus according to claim 8, wherein the second-kind overlap range includes a plurality of lines, and the controller is configured to control the head unit to discharge the second-kind liquid droplets on a part of the lines for one movement in the main scanning direction.

10. The liquid droplet discharge apparatus according to claim 9, wherein the lines include a first line and a second line adjacent to the first line in the sub-scanning direction, the head unit includes a plurality of second-kind nozzles as the at least one second-kind nozzle, the second-kind nozzles include a second-kind preceding nozzle and a second-kind succeeding nozzle, and the controller is configured to control the head unit to:

discharge the second-kind liquid droplets from the second-kind preceding nozzle to print the first line; and discharge the second-kind liquid droplets from the second-kind succeeding nozzle to print the second line.

11. The liquid droplet discharge apparatus according to claim 10, wherein the controller is configured to control the conveyor to convey the recording medium in the sub-scanning direction from a first position to a second position after the head unit has printed the first line and before the head unit prints the second line, the first position being a position at which the second-kind preceding nozzle faces the first line, the second position being a position at which the second-kind succeeding nozzle faces the second line.

12. The liquid droplet discharge apparatus according to claim 11, wherein the second-kind preceding nozzle is adjacent to the second-kind succeeding nozzle in the sub-scanning direction.

13. The liquid droplet discharge apparatus according to claim 11, wherein the controller is configured to control the conveyor to convey the recording medium in the sub-scanning direction by a first conveyance amount or a second conveyance amount greater than the first conveyance amount, the first conveyance amount is a conveyance amount for conveying the recording medium from the first position to the second position, the second-kind nozzles are aligned in the sub-scanning direction, the second-kind nozzles include second-kind end nozzles arranged on both ends in the sub-scanning direction, before the conveyor conveys the recording medium by the second conveyance amount, the controller is configured to control the head unit to discharge the second-kind liquid droplets on the second-kind overlap range from one of the second-kind end nozzles, and in a case that the conveyor conveys the recording medium by the first conveyance amount after the conveyor has conveyed the recording medium by the second conveyance amount, the controller is configured to control the head unit to discharge the second-kind liquid droplets on the second-kind overlap range from the other of the second-kind end nozzles.

14. The liquid droplet discharge apparatus according to claim 1, wherein the first data generation process includes:

a first-kind overlap range determination process for determining a first-kind overlap range, the first-kind overlap range being included in a range in the sub-scanning direction of the first-kind preceding dot area;

a first-kind excluded area determination process for determining a first-kind excluded area, the first-kind excluded area being included in the first-kind overlap range and not included in the first-kind preceding dot area;

a second-kind overlap range determination process for determining a second-kind overlap range, the second-kind overlap range being included in a range in the sub-scanning direction of the second-kind preceding dot area; and a second-kind excluded area determination process for determining a second-kind excluded area, the second-kind excluded range being included in the second-kind overlap range and not included in the second-kind preceding dot area, and the second data generation process includes:

a first-kind succeeding determination process for determining an area, which is included in the first-kind overlap range and not included in a dot area that is not the first-kind excluded area, as the first-kind succeeding dot area; and a second-kind succeeding determination process for determining an area, which is included in the second-kind overlap range and not included in a dot area that is not the second-kind excluded area, as the second-kind succeeding dot area.

15. The liquid droplet discharge apparatus according to claim 14, wherein the controller is configured to generate:

in the first data generation process, the first data so that a resolution in the sub-scanning direction of the second-kind preceding dot area is the same as a resolution in the sub-scanning direction of the first-kind preceding dot area; and in the second data generation process, the second data so that a resolution in the sub-scanning direction of the second-kind succeeding dot area is the same as a resolution in the sub-scanning direction of the first-kind succeeding dot area.

16. The liquid droplet discharge apparatus according to claim 14, wherein the controller is configured to generate:

in the first data generation process, the first data so that the range in the sub-scanning direction of the first-kind preceding dot area is identical to the range in the sub-scanning direction of the second-kind preceding dot area; and in the second data generation process, the second data so that the range in the sub-scanning direction of the first-kind succeeding dot area is identical to the range in the sub-scanning direction of the second-kind succeeding dot area.

17. The liquid droplet discharge apparatus according to claim 14, wherein the controller is configured to determine:

in the first-kind excluded area determination process, the first-kind excluded area by use of a first pattern determined in advance, and in the second-kind excluded area determination process, the second-kind excluded area by use of a second pattern determined in advance.

18. The liquid droplet discharge apparatus according to claim 17, wherein the second pattern is different from the first pattern.

19. The liquid droplet discharge apparatus according to claim 14, wherein the controller is configured to determine, in the second-kind overlap range determination process, the second-kind overlap range so that the second-kind overlap range is the same as the first-kind overlap range.

* * * * *